US005541360A

United States Patent [19]

Kaneko

[11] Patent Number: 5,541,360

[45] Date of Patent: Jul. 30, 1996

[54] SINGLE CHIP SOUND SOURCE INTEGRATED CIRCUIT INCLUDING EFFECT ADDING DEVICE AND SOUND SOURCE ON THE SAME SINGLE INTEGRATED CIRCUIT CHIP

[75] Inventor: Youji Kaneko, Kobubunji, Japan

[73] Assignee: Casio Computer Co., Ltd., Tokyo, Japan

[21] Appl. No.: 430,152

[22] Filed: Apr. 26, 1995

Related U.S. Application Data

[63] Continuation of Ser. No. 998,407, Dec. 29, 1992, abandoned.

[30] Foreign Application Priority Data

Apr. 7, 1992 [JP] Japan ..... 4-085262
Apr. 7, 1992 [JP] Japan ..... 4-085263

[51] Int. Cl.[6] ..... G10H 1/08; G10H 5/00
[52] U.S. Cl. ..... 84/660
[58] Field of Search ..... 84/625, 626, 629, 84/630, 660, 664

[56] References Cited

U.S. PATENT DOCUMENTS 4,437,377 3/1984 Mitarai et al. .
4,534,257 8/1985 Miturai .
4,998,281 3/1991 Sakata ..... 84/630 X
5,177,314 1/1993 Matsuda et al. ..... 84/615
5,182,415 1/1993 Kunimoto ..... 84/660
5,200,564 4/1993 Usami et al. ..... 84/602
5,241,604 8/1993 Noguchi ..... 84/630 X
5,286,914 2/1994 Kunimoto ..... 84/660 X
5,290,969 3/1994 Kobayashi ..... 84/660 X

*Primary Examiner*—William M. Shoop, Jr.
*Assistant Examiner*—Jeffrey W. Donels
*Attorney, Agent, or Firm*—Frishauf, Holtz, Goodman, Langer & Chick

[57] ABSTRACT

A sound source is composed of a plurality of chips of integrated circuits, into which a sound source circuit and an effector circuit are integrated. In a chip of integrated circuit, a waveform signal generated by the sound source circuit within the integrated circuit itself is compounded with a waveform signal generated by other sound source circuit in other chip of integrated circuit, and the resultant signal is applied with effect by the effector circuit.

Further, in a chip of integrated circuit, a waveform signal generated by the sound source circuit within the integrated circuit itself is compounded with a waveform signal generated by other sound source circuit in other chip of integrated circuit, and the mixed signal is applied with effect by the effector circuit, and further the effect added signal is transferred to the above other chip of integrated circuit, thereby the signal being applied with other effect.

26 Claims, 19 Drawing Sheets

SINGLE CHIP SOUND SOURCE INTEGRATED CIRCUIT INCLUDING EFFECT ADDING DEVICE AND SOUND SOURCE ON THE SAME SINGLE INTEGRATED CIRCUIT CHIP

This application is a Continuation, of application Ser. No. 07/998,407, filed Dec. 29, 1992, now abandoned.

BACKGROUND OF THE INVENTION

1. Field of the Invention

The present invention relates to a sound source integrated circuit including an effect adding device and a sound source apparatus using the sound source integrated circuit, which are employed in an electronic musical instrument for generating musical tones.

2. Description of the Related Art

A recent remarkable development of LSI techniques has brought integrated circuits, which include various functions within one chip. A sound source LSI, for example, of an electronic musical instrument includes a digital signal processor (DSP) for adding effects onto a sound signal. As a result, an electronic system, which employs an effector of a high performance for adding reverberation and other like effects on a sound signal, has been available at a low price.

FIG. 1 is a view illustrating a whole structure of a conventional electronic keyboard instrument with a chip of a sound source LSI equipped therein. In FIG. 1, a central processing unit (CPU) 1803 scans operating states of a keyboard 1801 and a switch unit 1802. Based on the result of the scanning operation, the CPU 1803 controls generation of sounds of a sound source LSI 1804. The sound source LSI 1804 generates a musical tone signal in accordance with instructions supplied from the CPU 1803, and performs an effecting process on the musical tone signal, using a random access memory (RAM) 1805 as a time delay memory. The resultant digital musical tone signal is further supplied to a D/A convertor 1806. The D/A convertor 1806 converts the supplied digital musical tone signal into an analog musical tone signal, which is audibly output through an amplifier 1806 and a speaker 1808.

FIG. 2 is a view illustrating a whole structure of other conventional electronic keyboard instrument of high quality, which employs two chips of sound source LSIs to be distinguished from widely used instruments in tone color and the number of polyphonic tones.

The electronic keyboard instrument of FIG. 2 is different from the instrument of FIG. 1 merely in that musical tone signals are generated by two sound source LSIs 1904, 1905 instead of a single sound source LSI, and are subjected to the effect process. With respect to other points, the electronic keyboard instrument of FIG. 2 operates in a similar manner to the instrument of FIG. 1. The musical tone signals are subjected to the effect process and D/A conversion. Two musical tone signals output from D/A convertors 1907, 1909 are sent to an amplifier 1910, where these signals are mixed together, and audibly output through a speaker 1911.

FIG. 3 is a view illustrating a whole structure of the other conventional electronic keyboard instrument of high quality, which employs two chips of sound source LSIs to be distinguished from widely used instruments in tone color and the number of polyphonic tones.

In FIG. 3, a CPU 21101 scans operating states of a keyboard 21101, switch unit 21102, and controls generation of sounds by sound source LSIs 21104, 21105 based on the result of the scanning operation. The sound source LSIs 21104, 21105 generate musical tone signals in accordance with instruction supplied from the CPU 21103, and supplies the musical tone signals to a DSP 21106 for effecting process. A DSP which is superior in performance than that used in the sound source LSI 1004 of FIG. 1 is used as the DSP 21106.

The DSP 21106 performs an effect process on the musical tone signals transferred from the sound source LSIs 21104, 21105, using a RAM 21107 for a time delay process. The resultant digital musical tone signal is converted into an analog signal by a D/A convertor 21108, and then audibly output through an amplifier 21109 and a speaker 21110.

As described above, when a plurality of chips of sound source LSIs are used, each of the plural chips of sound source LSIs performs an effect process independently of each other, so that each of the plural chips of sound source LSIs needs its own components such as a RAM for a time delay process and a D/A convertors for the DSP of the respective sound source LSI for performing an effect process. As a result, usage of a large number of chips of sound source LSIs in an electronic system invites such various problems as make the system large in size, and raise manufacturing costs.

Furthermore, usage of a large number of chips of sound source LSIs in an electronic system of a high grade needs expensive DSPs, of high performance, specialized for executing effect processes of high quality, resulting in a large sized system and increased manufacturing costs.

SUMMARY OF THE INVENTION

The present invention has an object to provide an electronic system which employs a plurality of LSI chips, which include sound source LSIs having DSP for adding effects on signals, with least number of elements to be externally connected thereto such as a RAM for delaying processing, a D/A convertor and the like.

Yet another object of the present invention is to provide an electronic system which employs a plurality of LSI chips each including a sound source LSI having DSP for adding effects on a signal, and which is capable of performing an effect adding process of high quality, without using an LSI specialized in effect adding.

According to a first aspect of the present invention, there is provided a sound source integrated-circuit including an effect adding device, comprising:

musical tone signal generating means for generating a musical tone signal;

input means for entering a musical tone signal externally supplied thereto;

mixing means for mixing the musical tone signal generated by the musical tone signal generating means with the musical tone signal entered by the input means to generate a mixed signal;

effect adding means for applying sound effect such as chorus effect and reverberation effect onto the mixed signal received from the mixing means to generate an effect-added signal; and output means for outputting the effect-added signal received from the effect adding means to an external D/A convertor.

The above musical tone signal generating means generates a musical tone signal based on a PCM sound source system, a frequency modulation sound source system, a phase modulation system and a harmonics synthesis sound source system.

Further the above mentioned input means includes serial/parallel converting means which receives a musical tone signal of a serial data format externally supplied thereto, and converts the received musical tone signal into a signal in a parallel data format so as to be processed within the sound source integrated-circuit.

According to a second aspect of the present invention, there is provided a sound source integrated-circuit including an effect adding device, comprising:

musical tone signal generating means; input means;

mixing means; effect adding means; and output means (first output means), all of which are the same as those of the sound source integrated-circuit of the first aspect of the invention.

The sound source integrated circuit of the second aspect of the invention further comprises another output means (second output means) which externally outputs the mixed signal received from the mixing means. The second output means includes parallel/serial converting means for converting the mixed signal of a parallel data format received from the mixing means into a signal in a serial data format and externally outputting the signal of a serial data format.

According to a third aspect of the invention, there is provided a sound source apparatus comprising:

multiple stages of the sound source integrated-circuits which are connected in cascade, and each of which includes:

musical tone signal generating means; input means; mixing means; effect adding means; first output means; and second output means, all of which are the same as those of the sound source integrated-circuit of the second aspect of the invention, wherein the second output means of the respective stages of the sound source integrated-circuits are connected to the input means of the following stages of sound source integrated-circuits to transfer the mixed signals generated by the mixing means, and the first output means of the last stage of the sound source integrated-circuit externally outputs the effect-added signal received from the effect adding means.

According to a fourth aspect of the invention, there is provided a sound source integrated-circuit including an effect adding device, comprising:

musical tone signal generating means for generating a plurality of time-shared musical tone signals;

input means for entering musical tone signals externally supplied thereto, the musical tone signals being classified into a plurality of signal groups;

classifying means for classifying the plurality of time-shared musical tone signals generated by the musical tone signal generating means into the same number of signal groups as those of the musical tone signals supplied to the input means;

mixing means for mixing respective signal groups of the time-shared musical tone signals classified by the classifying means with the relevant signal groups of the musical tone signals entered by the input means respectively to generate a plurality of signal groups of mixed signals;

effect adding means for adding sound effect to the respective signal groups of mixed signals received from the mixing means to generate effect-added signals; and output means for externally outputting the effect-added signals received from the effect adding means. For example, the output means outputs two channels of stereo phonic musical tone signals to an external D/A convertor.

In the sound source integrated-circuit of the fourth aspect of the invention, the above musical tone signal generating means generates, for example, a musical tone signal of 16-tone polyphony based on a PCM sound source system, a frequency modulation sound source system, a phase modulation system and a harmonics synthesis sound source system.

The input means enters musical tone signals which are classified and accumulated into four signal groups, such as left channel signals, right channel signals, first effect signals and second effect signals. The input means includes serial/parallel converting means which receives, for example, musical tone signals of a serial data format successively and externally supplied thereto, and converts the received musical tone signals into signals in a parallel data format so as to be processed within the sound source integrated-circuit.

The classifying means multiplies the respective groups of time shared channel musical tone signals by relevant coefficients every sampling intervals, and accumulates the products of each group.

Further, the effect adding means applies chorus effect and reverberation effect of some characteristics onto the first effect signals, and further applies chorus effect and reverberation effect of another characteristics onto the second effect signals, respectively, and adds two channels of the resultant signals to the left channel signals and the right channel signals respectively to generate two channels of stereo phonic musical tone signals. The effect adding means is realized, for example, by a digital signal processing device provided within the sound source integrated-circuit.

According to a fifth aspect of the invention, there is provided a sound source integrated-circuit including an effect adding device, comprising:

musical tone signal generating means; input means; classifying means; mixing means; effect adding; output means (first output means), which are the same as those of the sound source integrated-circuit of the fourth aspect of the invention. The sound source integrated-circuit further comprises a second output means for externally outputting the plurality of signal groups of mixed signals received from the mixing means. The second output means includes parallel/serial converting means which converts the signal groups of mixed signals of a parallel data format received from the mixing means into signals in a serial data format and externally outputs the signals of a serial format.

According to a sixth aspect of the invention, there is provided a sound source apparatus comprising:

multiple stages of sound source integrated-circuits connected in cascade, which sound source integrated-circuit is the same as that of the fifth aspect of the invention, wherein second output means of the respective stages of the sound source integrated-circuits are connected to input means of the following stage of sound source integrated-circuits for transferring mixed musical tone signals, and first output means of the last stage of the sound source integrated-circuit externally outputs effect-added signals.

In the sound source integrated-circuits of the first and the fourth aspects of the invention, the musical tone signals generated by the musical tone signal generating means can be mixed with the musical tone signal externally supplied through the input means by means of the mixing means. The mixed signal is applied with sound effect by the effect adding means, and then the effect-added signal is output through the output means to an external D/A convertor.

In this manner, the sound source integrated-circuits of the first aspect and the fourth aspect of the invention can efficiently apply sound effect on the musical tone signal generated therein and on the musical tone signal externally generated. Only one unit of peripheral components used for a sound-effect adding process, such as an external RAM and a D/A convertor, are needed to be connected with one sound source integrated-circuit. As a result, enlargement of a scale of a sound system may be prevented.

The sound source integrated-circuits of the second aspect and the fifth aspect of the invention are provided with the second output means, which serves to externally output the mixed signal received from the mixing means, in addition to the elements of the sound source integrated-circuit of the first aspect of the invention.

In the sound source apparatus of the third aspect of the invention, the sound source integrated-circuits of the second aspect of the invention are connected in cascade. Meanwhile, in the sound source apparatus of the sixth aspect of the invention, the sound source integrated-circuits of the fifth aspect of the invention are connected in cascade.

In these sound source apparatus of the third aspect and the sixth aspect of the invention, the sound source integrated-circuit of the same structure can be used in two ways, that is, the integrated-circuit can be used as a circuit specialized in generating a musical tone signal and as a circuit specialized in generating a musical tone signal and adding sound effect on the generated musical tone signal. Therefore, the cascade connection of the above sound source integrated-circuits allows the sound source integrated-circuit to be use for general purposes.

With the structure of the sound source apparatus of the third aspect and the sixth aspect of the invention, only one unit of output components for a sound-effect adding process, such as an external RAM and a D/A convertor, are needed to be connected only to the sound source integrated-circuit for adding sound effect. As a result, enlargement of a scale of a sound system may be prevented.

The sound source integrated-circuits of the fourth aspect and the fifth aspect of the invention and the sound source apparatus of the sixth aspect of the invention are provided with a classifying circuit which classifies musical tone signals into a plurality of groups, and processes the plurality of groups of musical tone signals. With the structure of the above sound source integrated-circuits and the sound source apparatus, the classifying circuit allows a sound source integrated-circuit of a cheap price and of simple structure to execute processes such as a stereo signal process, which require high performance.

According to seventh aspect of the invention, there is provided a sound source integrated-circuit including an effect adding device, comprising:

musical tone signal generating means for generating a musical tone signal;

first input means for entering a first musical tone signal externally supplied thereto;

mixing means for mixing the musical tone signal generated by the musical tone signal generating means with the first musical tone signal received from the first input means to generate a mixed signal;

second input means for entering a second musical tone signal externally supplied thereto;

selecting means for selecting either of the mixed signal supplied from the mixing means and the second musical tone signal supplied from the second input means;

effect adding means for adding sound effect such as chorus effect and reverberation effect to the signal selected by the selecting means to generate an effect added signal; and output means for outputting the effect-added signal of a serial data format, which is supplied from the effect adding means, to an external sound source LSI or D/A convertor.

In the sound source integrated-circuit of the seventh aspect of the invention, the musical tone signal generating means generates a musical tone signal based on the PCM sound source system, the frequency modulation sound source system, the phase modulation system and the harmonics synthesis sound source system.

Further, the first input means includes serial/parallel converting means which receives the first musical tone signal of a serial data format supplied, for example, from the external sound source LSI thereto, and converts the first musical tone signal into a signal in a parallel data format so as to be processed within the sound source integrated-circuit.

Meanwhile, the second input means includes serial/parallel converting means which receives the second musical tone signal of a serial data format externally supplied from an external DSP, and converts the second musical tone signal into a signal in a parallel data format so as to be processed within the sound source integrated-circuit.

The effect adding means will be realized, for example, with a digital signal processing device provided within the sound source integrated-circuit.

According to an eighth aspect of the invention, there is provided a sound source integrated-circuit including an effect adding device, comprising:

musical tone signal generating means; first input means; mixing means; second input means; selecting means; effect adding means; output means (first output means), which are the same as those of the sound source integrated-circuit of the seventh aspect of the invention, and second output means which externally outputs a mixed signal received from the mixing means.

The second output means includes parallel/serial converting means which converts a mixed signal of a parallel data format supplied from the mixing means into a signal in a serial data format and externally outputs the signal of a serial data format.

According to a ninth aspect of the invention, there is provided a sound source integrated-circuit including an effect adding device, comprising:

musical tone signal generating means for generating a plurality of time-shared musical tone signals;

first input means for entering first musical tone signals externally supplied thereto, the first musical tone signals being classified into a plurality of signal groups;

classifying means for classifying the plurality of time-shared musical tone signals generated by the musical tone signal generating means into the same number of signal groups as those of the first musical tone signals supplied to the first input means;

mixing means for mixing the respective signal groups of the time-shared musical tone signals classified by the classifying means with the relevant signal groups of the first musical tone signals received from the first input means respectively to generate a plurality of signal groups of mixed signals;

second input means for entering second musical tone signals externally supplied thereto, the second musical tone signals being classified into the same number of signal groups as those of the first musical tone signals;

selecting means for selecting either of the plurality of signal groups of mixed signals and the plurality of signal groups of second musical tone signals received from the second input means;

effect adding means for adding sound effect to the plurality of signal groups of signals selected by the selecting means to generate effect-added signals; and output means for externally outputting the effect-added signals of a serial data format received from the effect adding means to an external sound source LSI or D/A convertor.

In the sound source integrated-circuit of the ninth aspect of the invention, the musical tone generating means generates, for example, a musical tone signal of 16-tone polyphony based on the PCM sound source system, the frequency modulation sound source system, the phase modulation system and the harmonics synthesis sound source system. The first input means receives the first musical tone signals from an external sound source LSI, which signals are classified and accumulated into four groups: left channel signals, right channel signals, first effect signals and second effect signals. The first input means includes serial/parallel converting means which successively receives the musical tone signals of a serial data format from an external device, and converts the received musical tone signals into signals in a parallel data format so as to be processed in the sound source integrated-circuit.

The classifying means multiplies the respective groups of time shared channel musical tone signals by relevant coefficients every sampling intervals, and accumulates the products of each group.

The second input means receives the second musical tone signals, which are classified and accumulated into the above mentioned four groups, from a DSP of an external sound source LSI. This second input means includes serial/parallel converting means which receives the second musical tone signals of a serial data format externally supplied, and converts the second musical tone signal into signals in a parallel data format so as to be processed within the sound source integrated-circuit.

Further, the above effect adding means applies chorus effect and reverberation effect of some characteristics onto the first effect signals, and further applies chorus effect and reverberation effect of another characteristics onto the second effect signals, and outputs four groups of musical tone signals: two channels of the resultant signals, the left channel signals and the right channel signals. The effect adding means will be realized, for example, by a digital signal processing device provided within the sound source integrated-circuit.

Further, according to a tenth aspect of the invention, there is provided a sound source integrated-circuit including an effect adding device, comprising:

musical tone signal generating means; first input means; classifying means; mixing means; second input means; selecting means; effect adding means; first output means, which are the same as those of the sound source integrated-circuit of the ninth aspect of the invention, and second output means which externally outputs a plurality of signal groups of mixed signals received from the mixing means. This second output means includes parallel/serial converting means which converts signal groups of mixed signals of a parallel data format supplied from the mixing means into signals in a serial data format and successively outputs the signals of a serial data format.

In the sound source integrated-circuits of the seventh and the ninth aspects of the invention, the musical tone signal generated by the musical tone signal generating means can be mixed with the first musical tone signal externally supplied through the first input means by means of the mixing means. Second musical tone signal can be input through the second input means. The selecting means selects either of the mixed signal and the second musical tone signal input through the second input means. The selected signal is applied with sound effect by the effect adding means, and then the effect-added signal is output through the first output means to an external sound source LSI or D/A convertor.

In this manner, the sound source integrated-circuits of the seventh aspect and the ninth aspect of the invention can efficiently apply sound effect on the musical tone signal generated therein and on the musical tone signal externally generated. The effect-added musical tone signal may be supplied to other sound source integrated-circuit, in which the effect-added musical tone signal is applied with another sound effect. Therefore, a combination of the sound source integrated-circuits may apply sound effect onto a signal in various ways, and needs no expensive DSP of high performance to be externally connected therewith.

As described above, the sound source integrated-circuits of the eight aspect and tenth aspect of the invention further comprise the second output means, which externally outputs the mixed signal, in addition to the elements of the sound source integrated-circuits of the seventh and the ninth aspects of the invention.

Accordingly, in a cascade connection of the above sound source integrated-circuits, musical tone signals are generated by the respective sound source integrated-circuits and are successively mixed together to generate complicated musical tone signals, and at the same time the mixed musical tone signals are applied with arbitrary sound effect in the respective sound source integrated circuits.

Since, in the sound source integrated-circuits of the ninth and the tenth aspects of the invention, a circuit classifies musical tone signals into a plurality of groups, a sound source integrated-circuit of a low price can be employed for executing processes of high performance such as a stereophonic process.

It would be apparent to those skilled in the art from the following description of preferred embodiments that the present invention may be modified in various manners and may be applicable to other apparatus.

BRIEF DESCRIPTION OF THE DRAWINGS

Other objects and structures of the present invention will be more fully understood from the description, when taken in conjunction with the accompanying drawings, in which.

DETAILED DESCRIPTION OF PREFERRED EMBODIMENTS

Now, a first embodiment of the present invention will be described in detail with reference to the accompanying drawings.

Figure 1:
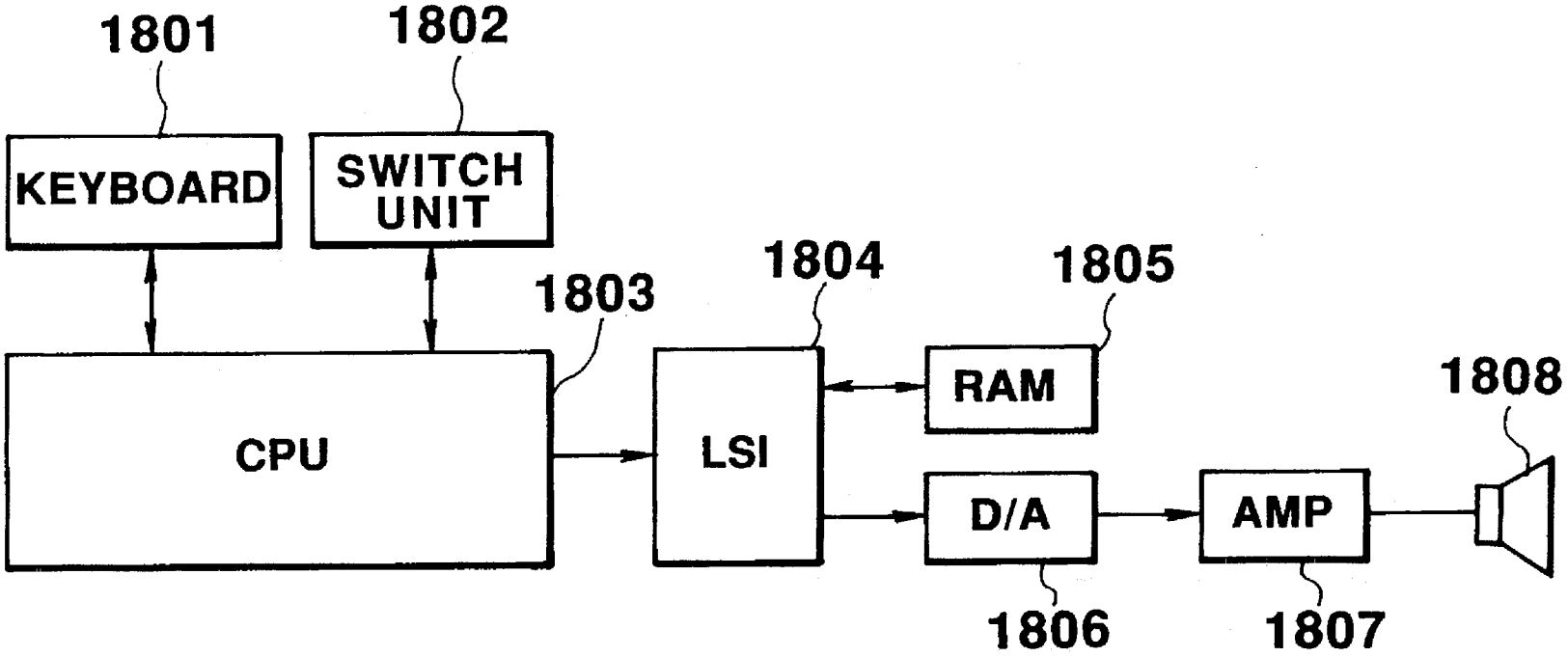
FIG.1 (PRIOR ART)
FIG. 1 is a block diagram of whole structure of a conventional electronic keyboard instrument using one chip sound source LSI.
Figure 2:
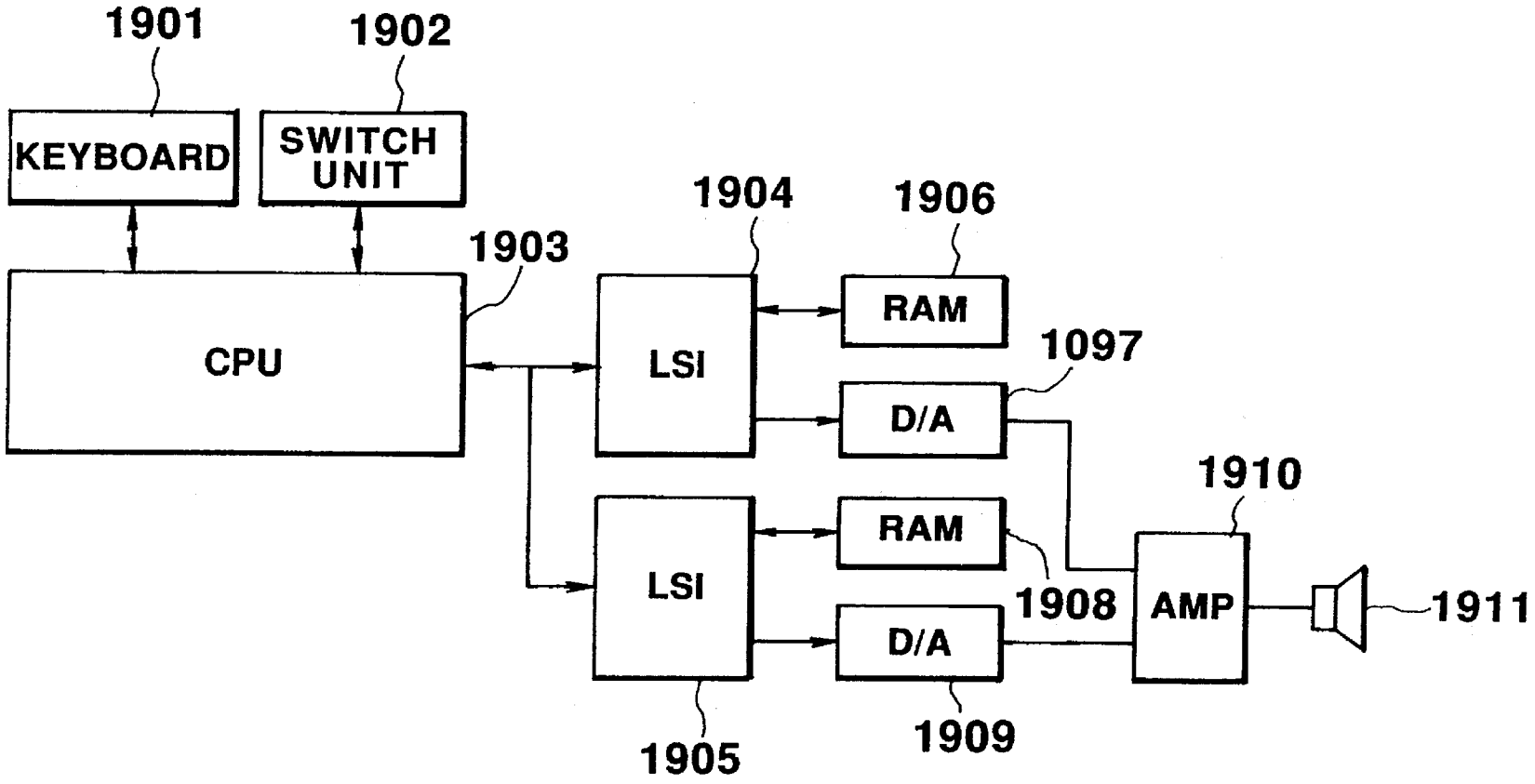
FIG.2 (PRIOR ART)
FIG. 2 is a block diagram of whole structure of a conventional electronic keyboard instrument using two chips of sound source LSIs.
Figure 3:
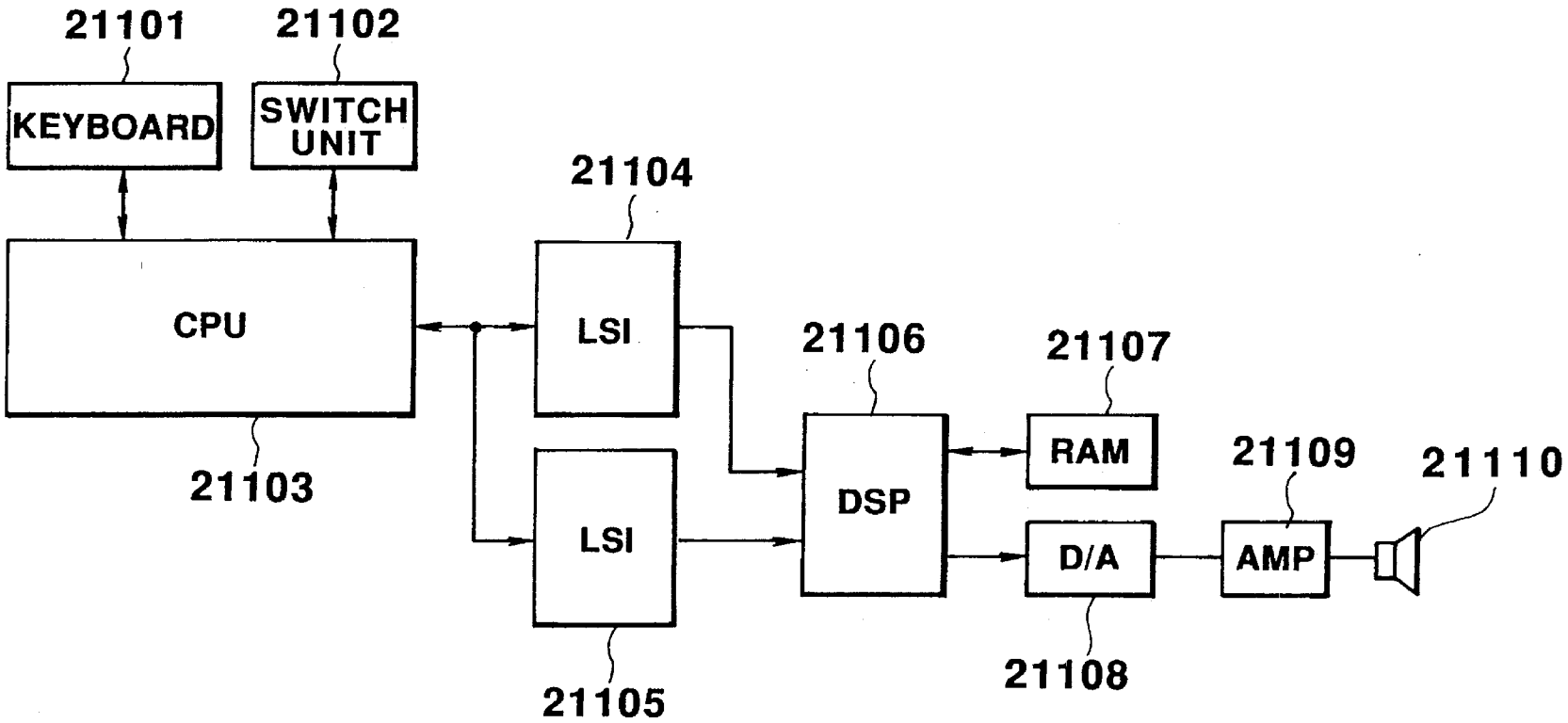
FIG.3 (PRIOR ART)
FIG. 3 is a block diagram of whole structure of another conventional electronic keyboard instrument using two chips of sound source LSIs.
Figure 4:
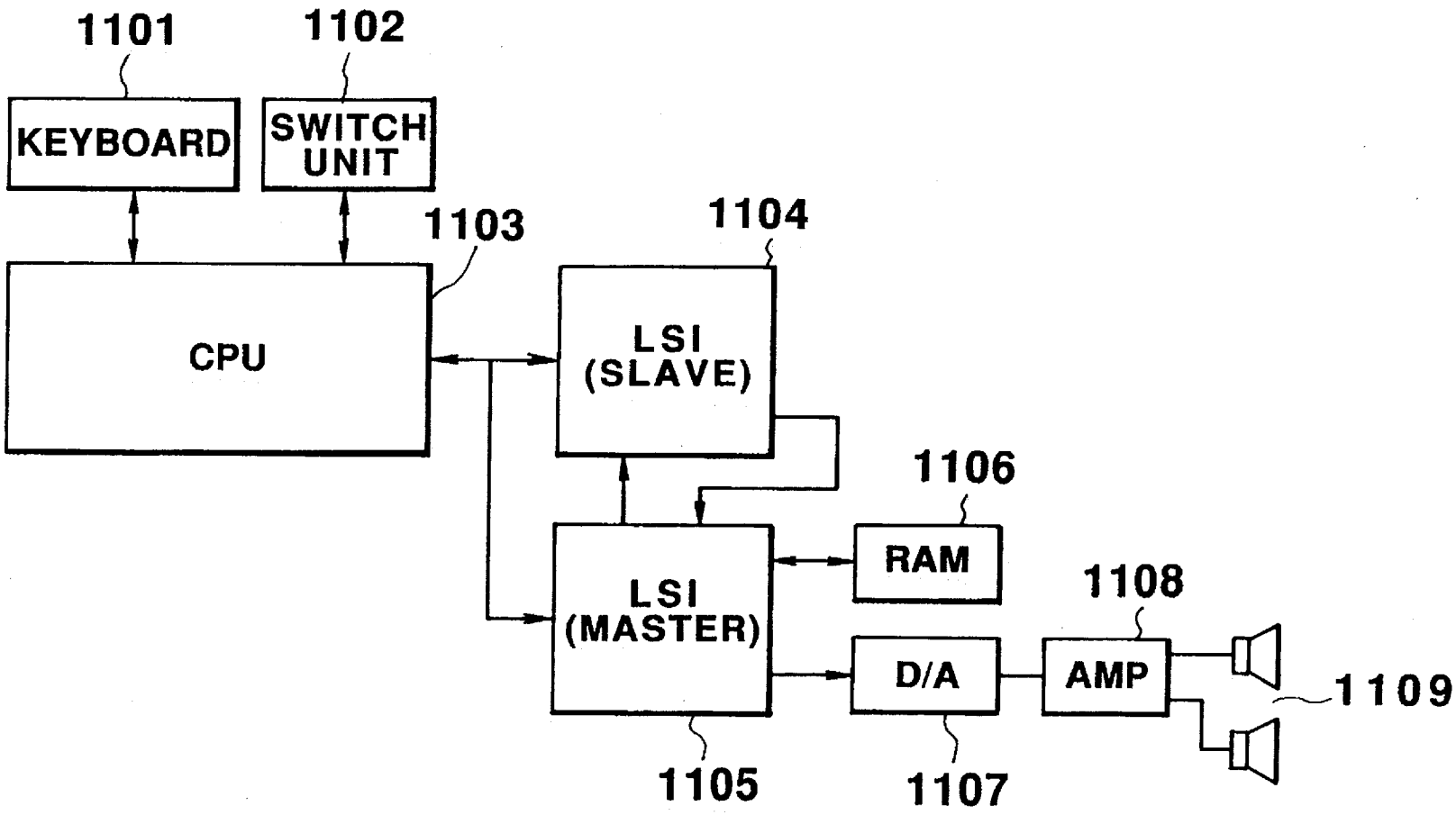
FIG. 4 is a block diagram of whole structure of a first embodiment of the present invention.

FIG. 4 is a view showing whole structure of the first embodiment of the invention applied to an electronic keyboard instrument.

In FIG. 4, a CPU 1103 scans operating state of a keyboard 1101 and a switch unit 1102, and controls sound source LSIs 1104 and 1105 depending on the result of the scanning operation. The sound source LSI 1104 serves as a slave circuit while the sound source LSI 1105 serves as a master circuit. The sound source LSI 1104 generates and accumulates musical tone signals of each sound channel, and transfers the accumulated signals to the master sound source LSI 1105.

The master sound source LSI 1105 accumulates musical tone signals of each sound channel generated within its own LSI, and adds the accumulated value to an accumulated value of musical tone signals transferred from the slave sound source LSI 1104 to obtain the sum. Further, the master sound source LSI 1105 executes effect process on the sum using an internal digital signal processor (DSP) and RAM 1106. The sum (musical tone signal) subjected to the effect process is converted into an analog signal. Musical tones based on the analog signal are audibly output through an amplifier 1108 and speakers 1109.

Figure 5:
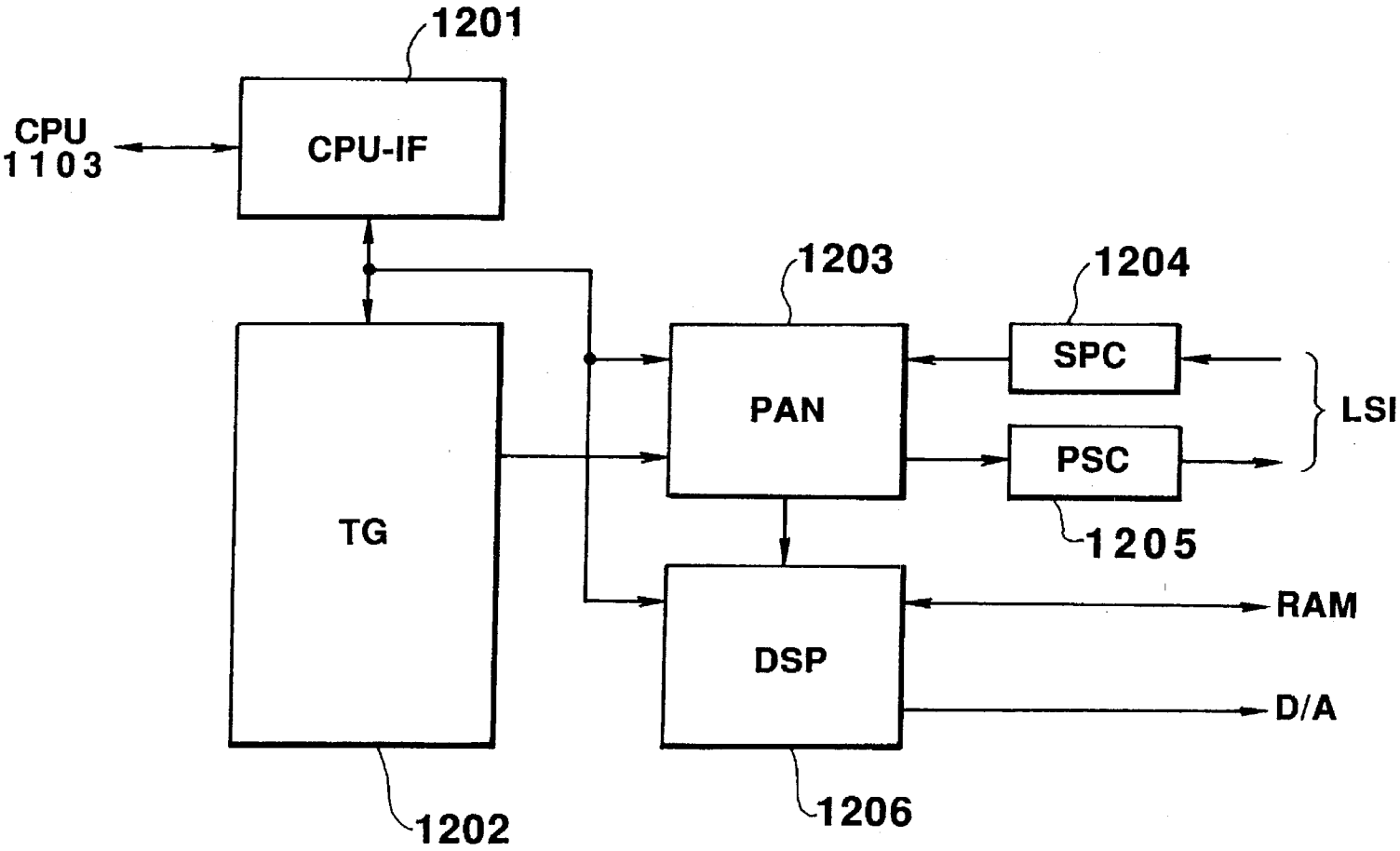
FIG. 5 is a block diagram of whole structure of a sound source LSI.

FIG. 5 is a block diagram showing whole structure of the sound source LSIs 1104 and 1105 used in the first embodiment.

In FIG. 5, performance data and various control signals sent from the CPU 1103 of FIG. 4 are transferred through an interface circuit (CPU-IF) 1201 to a musical tone generator (TG) 1202, a panning circuit (PAN) 1203 and a digital signal processor (DSP) 1206.

The musical tone generator (TG) 1202 generates a musical tone signal of 16 tone polyphony in a time sharing manner in accordance with the performance data sent from the CPU 1103. For generating the musical tone signal, various methods will be used. For example, if a PCM sound source method is used, a PCM waveform memory is built in the musical tone generator (TG) 1202 or the PCM waveform memory is externally connected to the sound source LSI 1104 or 1105.

The panning circuit (PAN) 1203, as will be described, classifies time-shared musical tone signals sent from the musical tone generator (TG) 1202 into four groups for executing the effect process thereon, and weights and accumulates four groups of musical tone signals, then transferring them to the DSP 1206 in a time sharing manner.

A serial/parallel convertor (SPC) 1204 is a convertor which converts a signal of a serial data format (serial data) transferred from other LSI into a signal in a parallel data format (parallel data). A parallel/serial convertor (PSC) 1205 is a convertor which converts parallel data into serial data to be transferred to other LSI.

The DSP 1206 performs effect process on a musical tone signal sent from the panning circuit (PAN) 1203, making use of the RAM 1106 as a delay memory, and outputs the resultant musical tone signal to the D/A convertor 1107.

Figure 6:
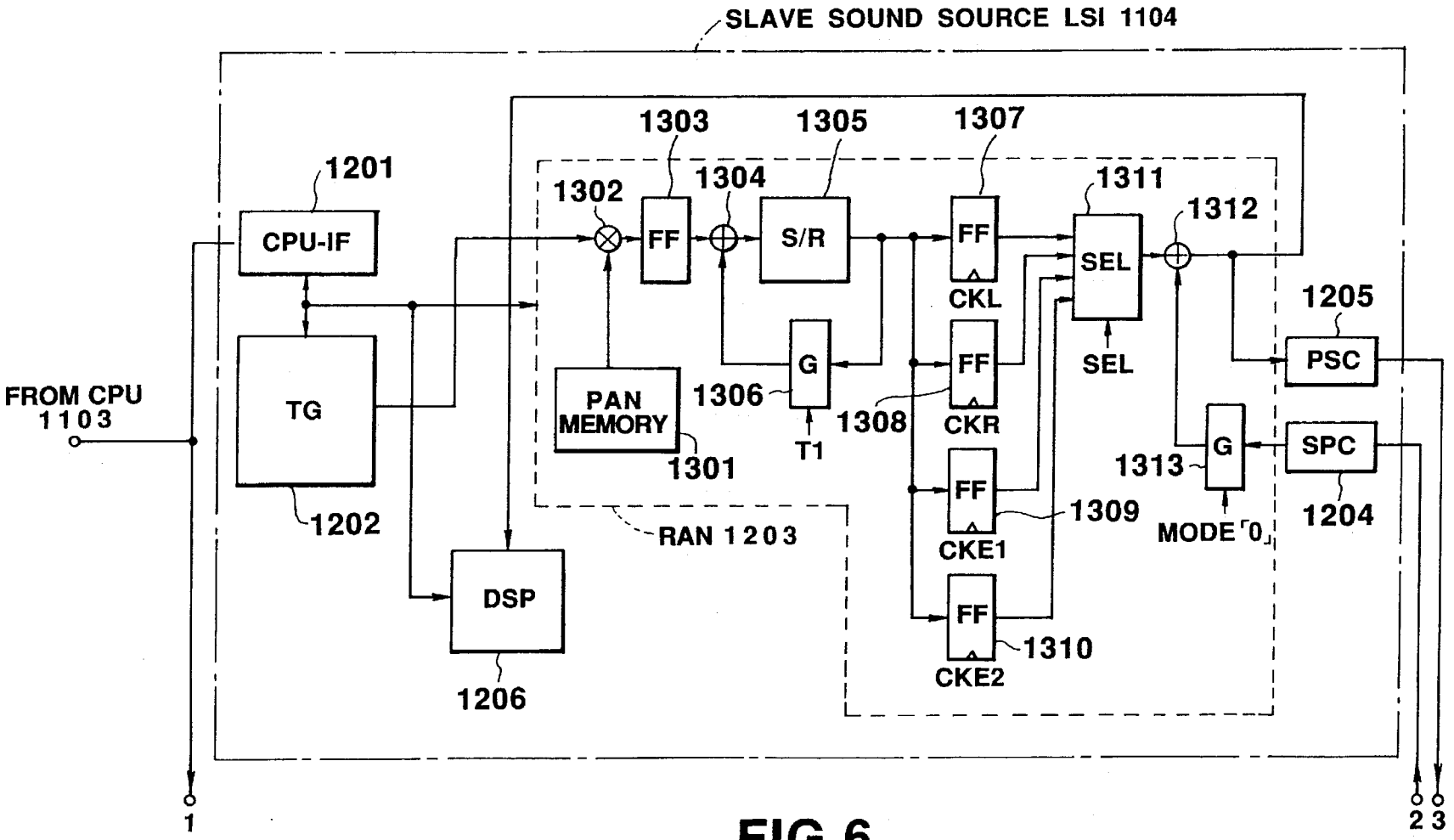
FIG. 6 is a block diagram of structure of a slave sound source LSI 1104 and PAN 1203.
Figure 7:
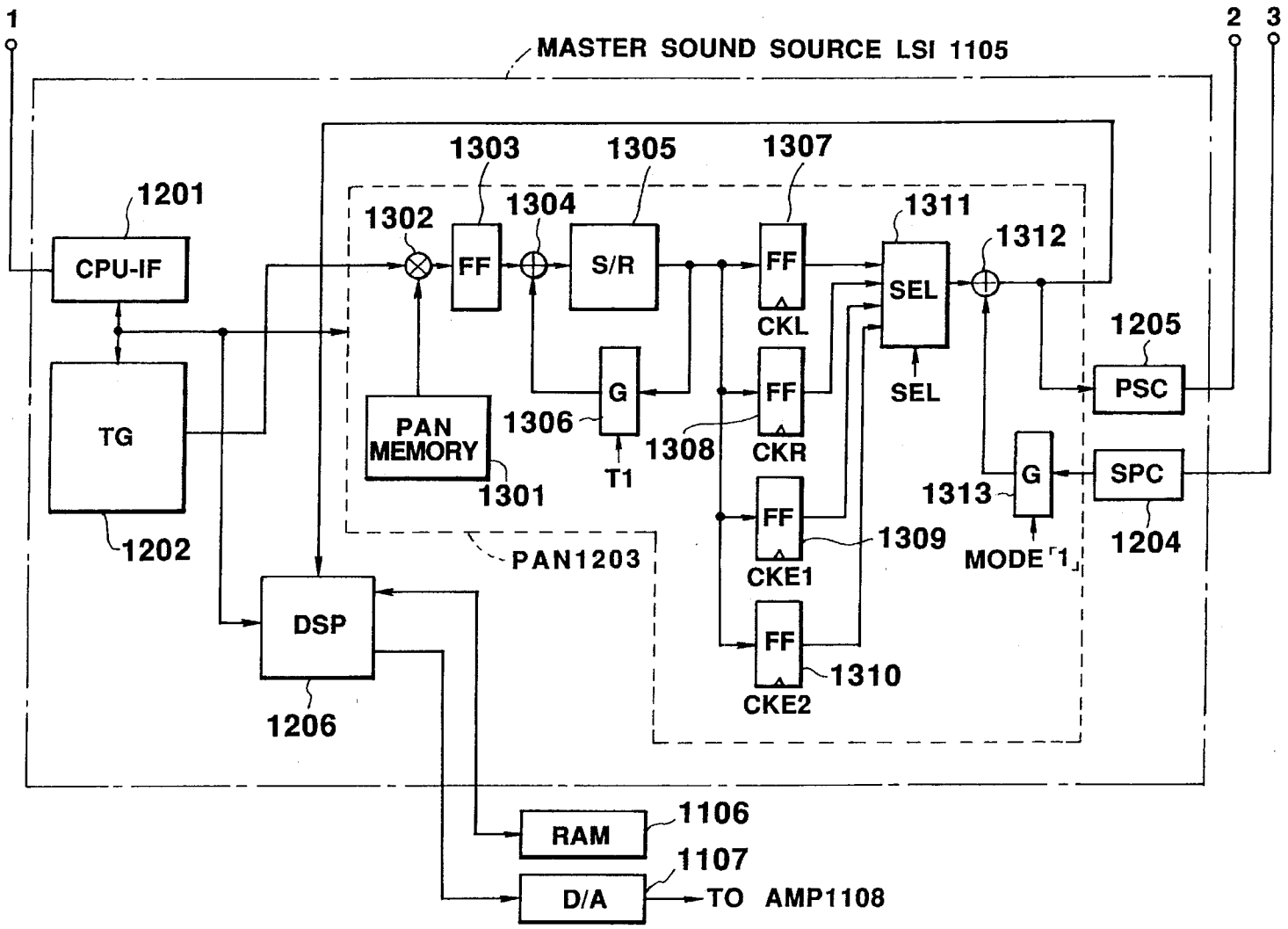
FIG. 7 is a block diagram of structure of a master sound source LSI 1105 and PAN 1203.

FIG. 6 is a block diagram of the whole structure of the slave sound source LSI 1104 including the panning circuit (PAN) 1203. Meanwhile, FIG. 7 is a block diagram of the whole structure of the master sound source LSI 1105 including the panning circuit (PAN) 1203. Both the slave and master sound source LSIs 1104, 1105 have the same structure, and are connected with each other at connecting points 1, 2 and 3, as shown in FIGS. 6, 7. These sound source LSIs perform effect process on a musical tone signal when a gate circuit 1313 and a selector 1311 are controlled, as will be described later.

The structure and effect processing operation of the sound source LSIs of FIGS. 6 and 7 will be described with reference to time charts of FIGS. 8 and 9.

Figure 8:
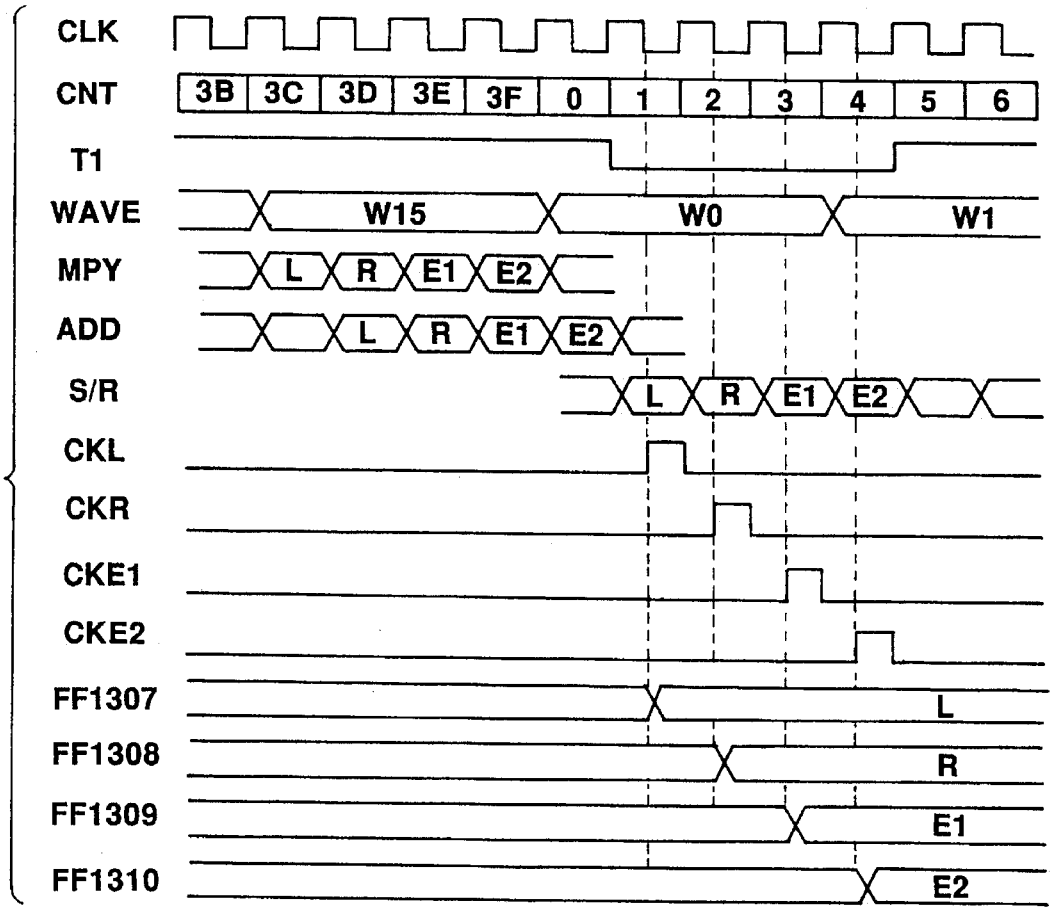
FIG. 8 is a time chart of PAN 1203.

Receiving performance data through the CPU-IF 1201 from the CPU 1103 of FIG. 4, the tone generator TG 1202 of the slave sound source LSI 1104 of FIG. 6 generates, in a time sharing manner, musical tone signals which are composed of 16 polyphonic tones having wave heights W15, W0, W1 and so on, shown at "WAVE" of FIG. 8. A "CLK" of FIG. 8 stands for an operation clock signal while "CNT" values of a counter for arithmetic performance timing. One cycle from W0 to W15 corresponds to one sampling period.

A PAN memory 1301 in the PAN 1203 successively outputs coefficient data stored therein, which data are used for weighting four groups of musical tone signals L, R, E1 and E2 for respective 16 channels. The coefficient data are multiplied with musical tone signals for respective channels, which signals are supplied in a time sharing manner from the tone generator TG 1202, as shown at "MPT" of FIG. 8, and the resultant signal is stored in a flip-flop circuit (FF) 1303.

The output of the flip-flop circuit 1303 is added to a feed back signal of a 4-stage shift register S/R 1305, as shown at "ADD" of FIG. 8.

As a result, the resultant accumulations L, R, E1, E2 for respective groups of the musical tone signals (W0 to W15) are output from the shift register S/R 1305, as shown at "S/R" of FIG. 8. Since a gate control signal "T1" varies as shown in FIG. 8, a gate circuit 1306 prevents the shift register S/R 1305 from feeding back the resultant accumulations of the respective musical tone signals (W0 to W15)

to the adder 1304 at timings when the shift register S/R 1305 outputs the resultant accumulations.

In accordance with latch clock signals CKL, CKR, CKE1 and CKE2 shown in FIG. 8, flip-flop circuits 1307, 1308, 1309 and 1310 store the resultant accumulations of the respective groups of musical tones output from the shift register S/R 1305, respectively. The latch clock signals CKL, CKR, CKE1 and CKE2 are output at timings of W0 to W1 of "WAVE".

Figure 9:
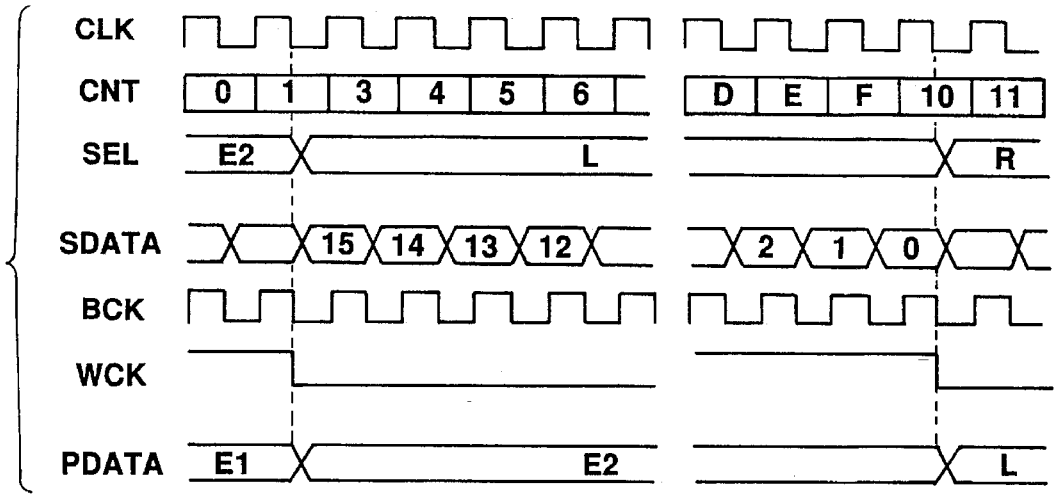
FIG. 9 is a time chart of a parallel/serial conversion.

Based on a control signal SEL shown at SEL of FIG. 9, the selector SEL 1311 sequentially outputs the resultant accumulations of the respective groups of musical tones stored in the flip-flop circuits 1307 to 1310 during periods, respectively, each of which periods is equivalent to one fourth of one sampling period. The sampling period corresponds to a period from 0 to 3F at CNT of FIG. 8.

The parallel/serial convertor 1205 converts the resultant accumulations received from the selector SEL 1311 into serial data of 16 bits (0 to 15) shown at SDATA of FIG. 9, respectively, based on the a bit clock signal BCK of FIG. 9. The serial data are successively output to the master sound source LSI 1105 of FIG. 4. It should be noted that the CLK and CNT of FIG. 9 are equivalent to CLK and CNT of FIG. 8, respectively.

In the master sound source LSI 1105 of FIG. 7, the serial data of the respective resultant accumulations sent from the slave sound source LSI 1104 of FIG. 6 are converted into parallel data shown at PDATA in FIG. 9 by the serial/parallel convertor (SPC) 1204 on the basis of a word clock signal WCK of FIG. 9, and the resultant parallel data are supplied to the gate circuit G 1313.

The gate circuit 1313 is supplied with a control signal MODE of a logic "1", thereby being made open. Therefore, the parallel data of the resultant accumulations sent from the slave sound source LSI 1104 of FIG. 6 are transferred to adder 1312, wherein the parallel data are added to musical tone signals generated and accumulated within the master sound source LSI 1105.

In the master sound source LSI 1105, musical tone signals of 16 polyphonic tones generated by the tone generator TG 1202 are accumulated into four groups L, R, E1 and E2 in a similar manner to that in the slave sound source LSI 1104.

It will be understood when SEL is compared with PDATA in FIG. 9 that the resultant accumulations of the slave sound source LSI 1104 are delayed by one group (word) while they are transferred from the slave sound source LSI 1104 to the master sound source LSI 1105.

Accordingly, the musical tone signals of the master sound source LSI 1105 and the musical tone signals of the slave sound source LSI 1104, which are shifted in timing by one word, will be added together. Therefore, the accumulating operation of musical tone signals will be performed in the master sound source LSI 1105 at a timing which is delayed by one group (word) compared with that in the slave sound source LSI 1104. For that purpose, a coefficient which is delayed by one group timing compared with that of the slave sound source LSI 1104 is previously written into the PAN memory 1301 of the master sound source LSI 1105.

In the master sound source LSI 1105 of FIG. 7, the sum obtained by the adder 1312 is transferred to the DSP 1206 and the parallel/serial convertor 1205.

The output of the parallel/serial convertor 1205 is supplied to the serial/parallel convertor 1204 of the slave sound source LSI 1104 of FIG. 6. But the gate circuit 1313 of the slave sound source LSI 1104 of FIG. 6 is supplied with a control signal MODE of a logic "0", thereby being made closed. Therefore, the sum sent from the master sound source LSI 1105 is not transmitted to the slave sound source LSI 1104.

Meanwhile, the sum supplied to the DSP 1206 of the master sound source LSI 1105 of FIG. 7, which uses the externally connected RAM 1106 of FIG. 4 as a memory for display, is subjected to the effect process.

Figure 10:
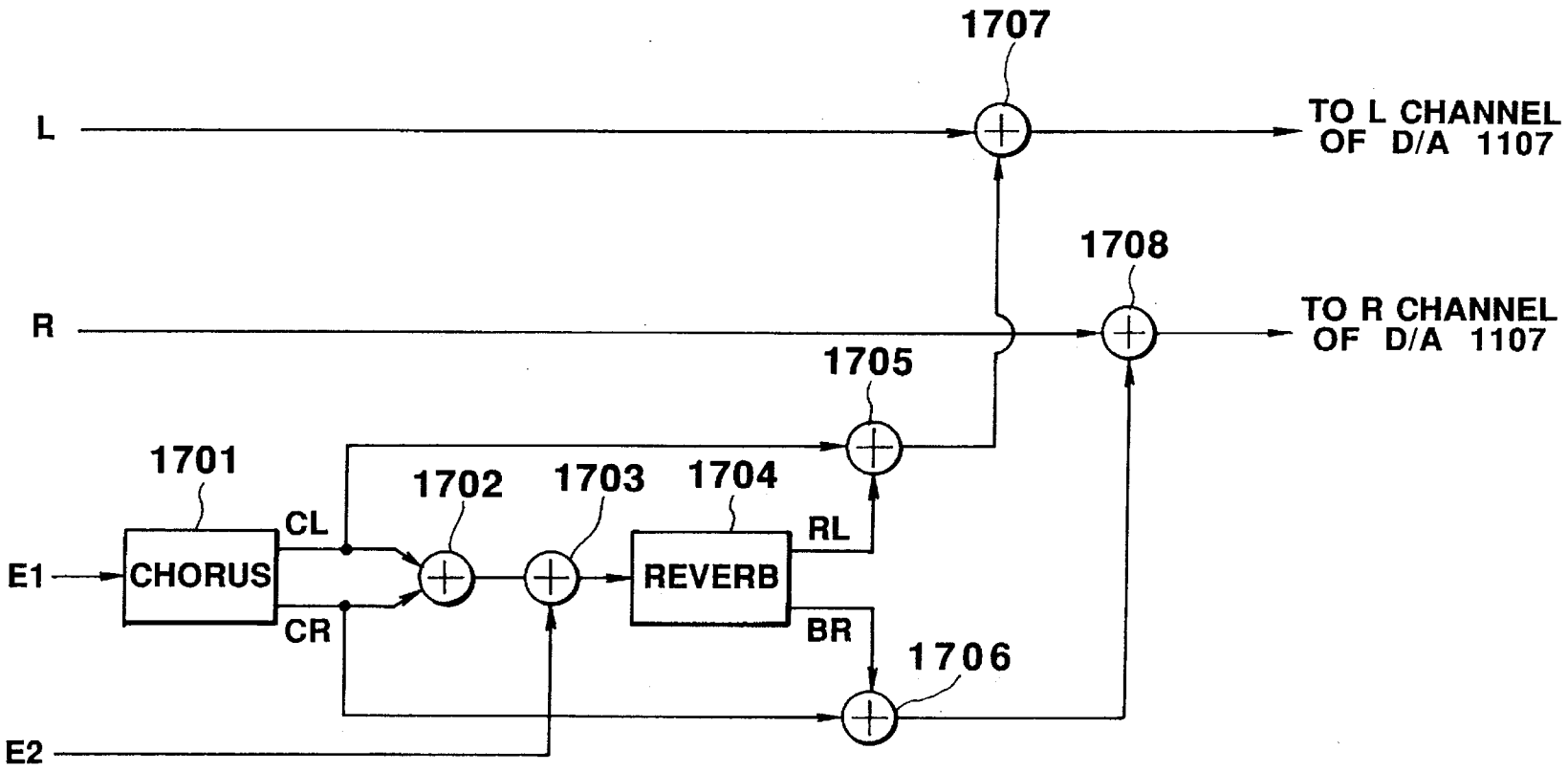
FIG. 10 is a functional block diagram showing an example of an effect process in DSP.

FIG. 10 is a functional block diagram of the effect process performed by the DSP 1206. In FIG. 10, L, R, E1 and E2 stand for accumulated values of four groups of musical tone signals, respectively.

A chorus adding unit 1701 adds a chorus effect to the musical tone signal E1, thereby developing a left component signal CL and a right component signal CR. These component signals CR, CL are supplied to adders 1705 and 1706, respectively, and are added together by an adder 1702 at the same time.

The output of the adder 1702 is added to the musical tone signal E2 by an adder 1703. The resultant signal is further supplied to a reverberation adding unit 1704. The reverberation adding unit 1704 adds a reverberation effect to the received signal, developing a left component signal RL and a right component signal RR. These component signals RL, RR are added to the component signals CL, CR by the adders 1705 and 1706, respectively, and the sum signals are supplied to adders 1707, 1708, respectively.

In this fashion, the musical tone signals E1, E2 are subjected to the effect process in the chorus effect adding unit 1701 and the reverberation adding unit 1704. In FIG. 10, the effect process will be performed in four manners in accordance with combination of values of the musical tone signals:

(1) E1=0 and E2 ≠0: only reverberation effect is added.

(2) E1 ≠0 and E2=0: chorus and reverberation effects are added.

(3) E1 ≠0 and E2 ≠0: chorus and reverberation effects are added.

(4) E1=0 and E2=0: none of chorus and reverberation effects is added.

Amplitudes of the signals E1, E2 are controlled in accordance with coefficients for the signals E1, E2 stored in the PAN memory 1301.

The signals which have been subjected to the effect process are added to the left component musical tone signal L and the right component musical tone signal R in the adders 1707, 1708, respectively. The resultant signals are supplied as an L channel signal and an R channel signal to the D/A convertor 1107 of FIG. 4. The respective signals are converted into analog signals by the D/A convertor 1107, and the effect added analog signals are audibly output through the amplifier 1108 and the speakers 1109.

As described above, the slave sound source LSI is capable of accumulating musical tone signals developed within the LSI, and transferring the accumulated signals to the master sound source LSI 1105. The master sound source LSI 1105 is capable of accumulating musical tone signals developed within the same LSI, and adding the signals thus accumulated and the accumulated signals supplied from the slave sound source LSI 1104. Further, the master sound source LSI 1105 is capable of performing the effect process on the resultant signals, and supplying the signals to the D/A convertor. In the first embodiment, two chips of sound source LSIs are used but more than two chips of LSIs may be used. When more than two chips of sound source LSIs are used, the coefficients which are delayed by appropriate timings are written into the PAN memories of the LSIs, respectively, so that the accumulated signals of the respective LSIs may be added in synchronism with one another.

With the structures of the sound source integrated-circuits according the first and the fourth aspects of the present invention, the effect adding means provided in the sound source integrated-circuits can efficiently add effects onto musical tone signals developed within the sound source integrated-circuits and onto externally generated musical tone signals.

Further, with the structures of the sound source integrated-circuits according the first and the fourth aspects of the present invention, only one set of output devices may be prepared such as an external RAM and D/A converter to be externally connected to a sound source integrated circuit for the effect adding purpose. Therefore, a compact size of a system including the above sound source integrated-circuit may be realized.

With the structures of the sound source integrated-circuits according the second or the fifth aspect and the third or the sixth aspect of the present invention, the sound source integrated-circuits of the same structure may be connected in cascade. The respective sound source integrated-circuits may be used as a circuit specialized for generating musical tones or a circuit specialized for the effect adding purpose. Therefore, these sound source integrated-circuits may be used for general purposes, allowing the manufacturing costs to be reduced.

With the above structures of the sound source integrated-circuits, only one set of output devices may be prepared such as an external RAM and D/A converter to be externally connected to a sound source integrated circuit for the effect adding purpose. Therefore, a compact size of a system including the above sound source integrated-circuit may be realized.

With the structures of the sound source integrated-circuits according the fourth to sixth aspects of the present invention, a not valuable sound source integrated-circuit may be used for performing a signal process of high performance such as a stereophonic signal process, when the integrated-circuit is provided with elements for classifying musical tone signals into plural groups and processing the classified musical tone signals.

Now, a second embodiment of the present invention will be described In detail.

Figure 11:
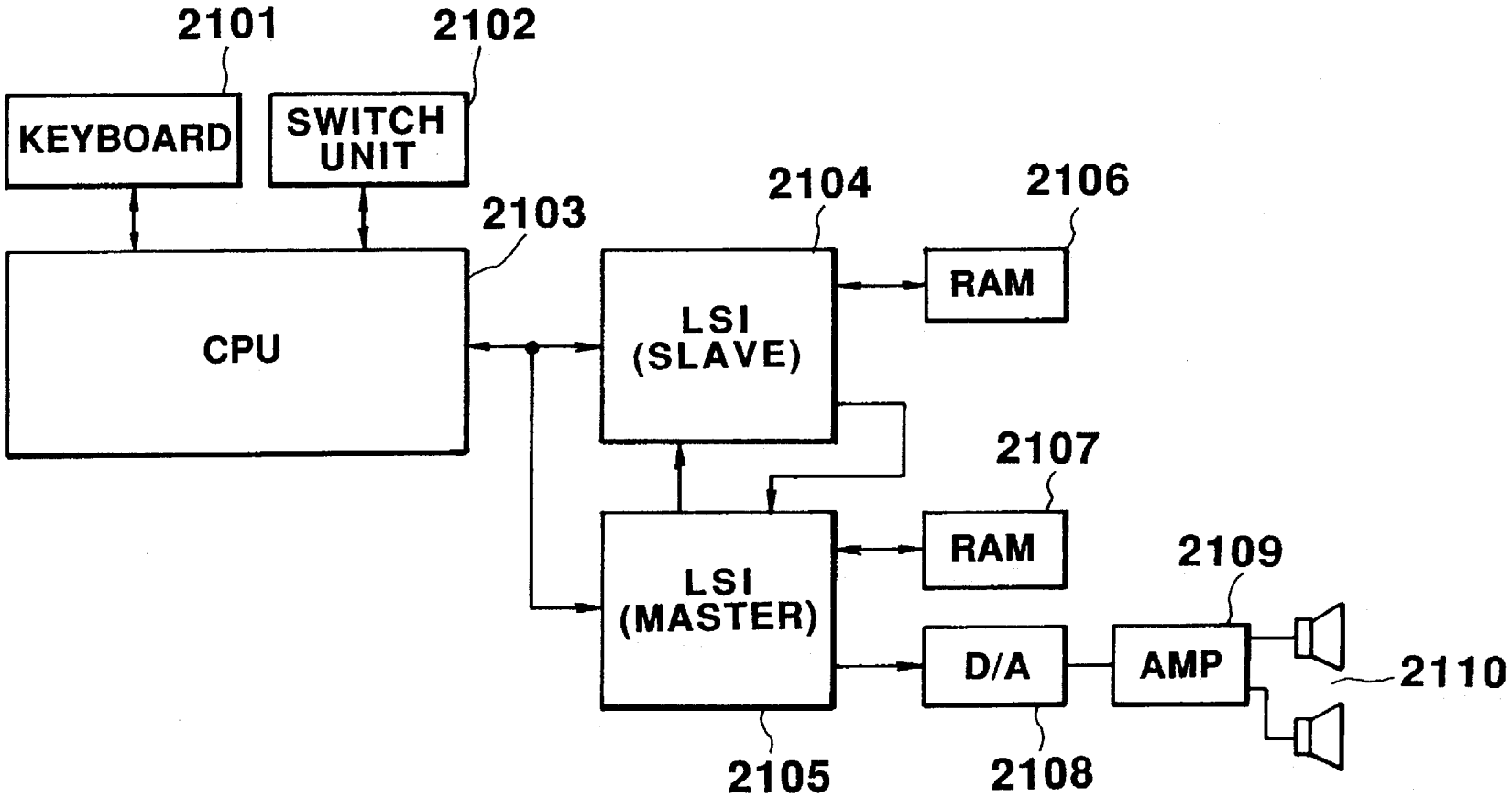
FIG. 11 is a block diagram of whole structure of a second embodiment of the present invention.

FIG. 11 is a view showing whole structure of an electronic keyboard instrument employing the second embodiment of the present invention. In FIG. 11, a CPU 2103 scans operating state of a keyboard 2101 and a switch unit 2102, and controls a sound source LSIs 2104 and 2105 in accordance with the result of the scanning operation.

The LSI 2105 is used as a master circuit. The LSI 2105 generates musical tone signals for respective sounding channels based on performance data supplied from the CPU 2103, and accumulates the generated musical tone signals, thereby developing an accumulated value, and transfers the accumulated value to a slave sound source LSI 2104.

The slave sound source LSI 2104 generates musical tone signals therein, and accumulates the musical tone signals, thereby developing accumulated value. The slave sound source LSI 2104 adds the accumulated value to the accumulated value transferred from the master sound source LSI 2105, and performs an effect process on the resultant value, using an internal digital signal processing unit (DSP) and a delay RAM 2106. A musical tone signal subjected to the effect process is transferred from an output port of a D/A converter in DSP to the master sound source LSI 2105.

The master sound source LSI 2105 performs an effect process on the transferred musical tone signal, using an internal DSP and a delay RAM 2107. The musical tone signal subjected to the effect process is transferred into an analog signal by A D/A converter 2108, and the analog signal is audibly output as effect added signals through an amplifier 2109 and speakers 2110.

Figure 12:
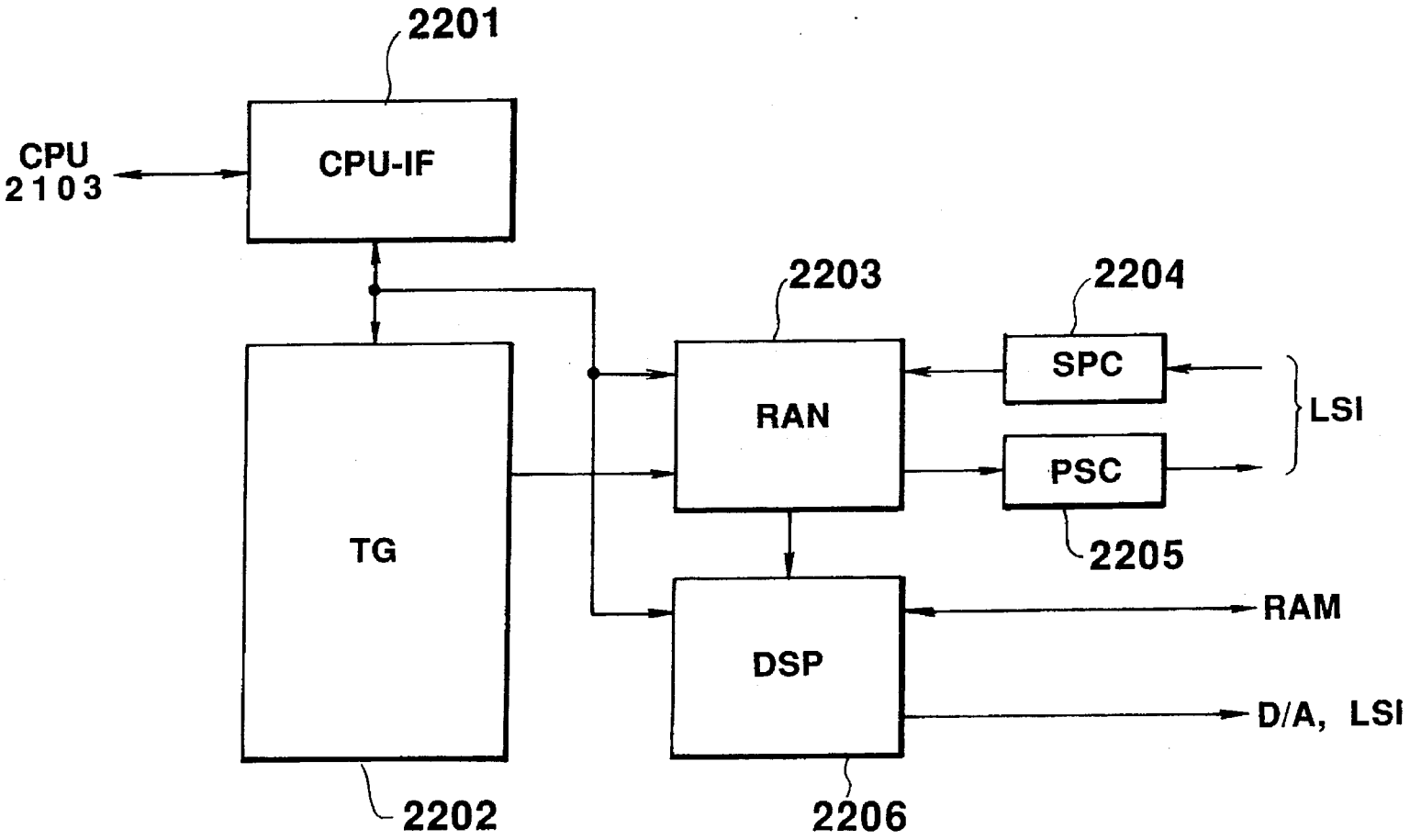
FIG. 12 is a block diagram of whole structure of a sound source LSI used in the second embodiment.

FIG. 12 is a block diagram showing whole structure of the sound source LSIs 1204 and 1205 used in the first embodiment.

In FIG. 12, performance data and various control signals sent from the CPU 2103 of FIG. 11 are transferred through an interface circuit (CPU-IF) 2201 to a musical tone generator (TG) 2202, a panning circuit (PAN) 2203 and a digital signal processor (DSP) 2206.

The musical tone generator (TG) 2202 generates a musical tone signal of 16 tone polyphony in a time sharing manner in accordance with the performance data sent from the CPU 1103. For generating the musical tone signal, various methods will be used. For example, if a PCM sound source method is used, a PCM waveform memory is built in the musical tone generator (TG) 2202 or the PCM waveform memory is externally connected to the sound source LSI 2104 or 2105.

The panning circuit (PAN) 2203, as will be described, classifies time-shared musical tone signals sent from the musical tone generator (TG) 2202 into four groups for executing the effect process thereon, and weights and accumulates four groups of musical tone signals, then transferring them to the DSP 2206 in a time sharing manner.

A serial/parallel convertor (SPC) 2204 is a convertor which converts a signal of a serial data format (serial data) transferred from other LSI into a signal in a parallel data format (parallel data). A parallel/serial convertor (PSC) 2205 is a convertor which converts parallel data into serial data (hereafter, para/serial conversion) to be transferred to other LSI.

The DSP 2206 performs an effect process on a musical tone signal sent from the panning circuit (PAN) 1203, making use of the RAM 2106 or 2107 as a delay memory, and outputs the resultant musical tone signal to the D/A convertor 2108 of FIG. 11.

Figure 13:
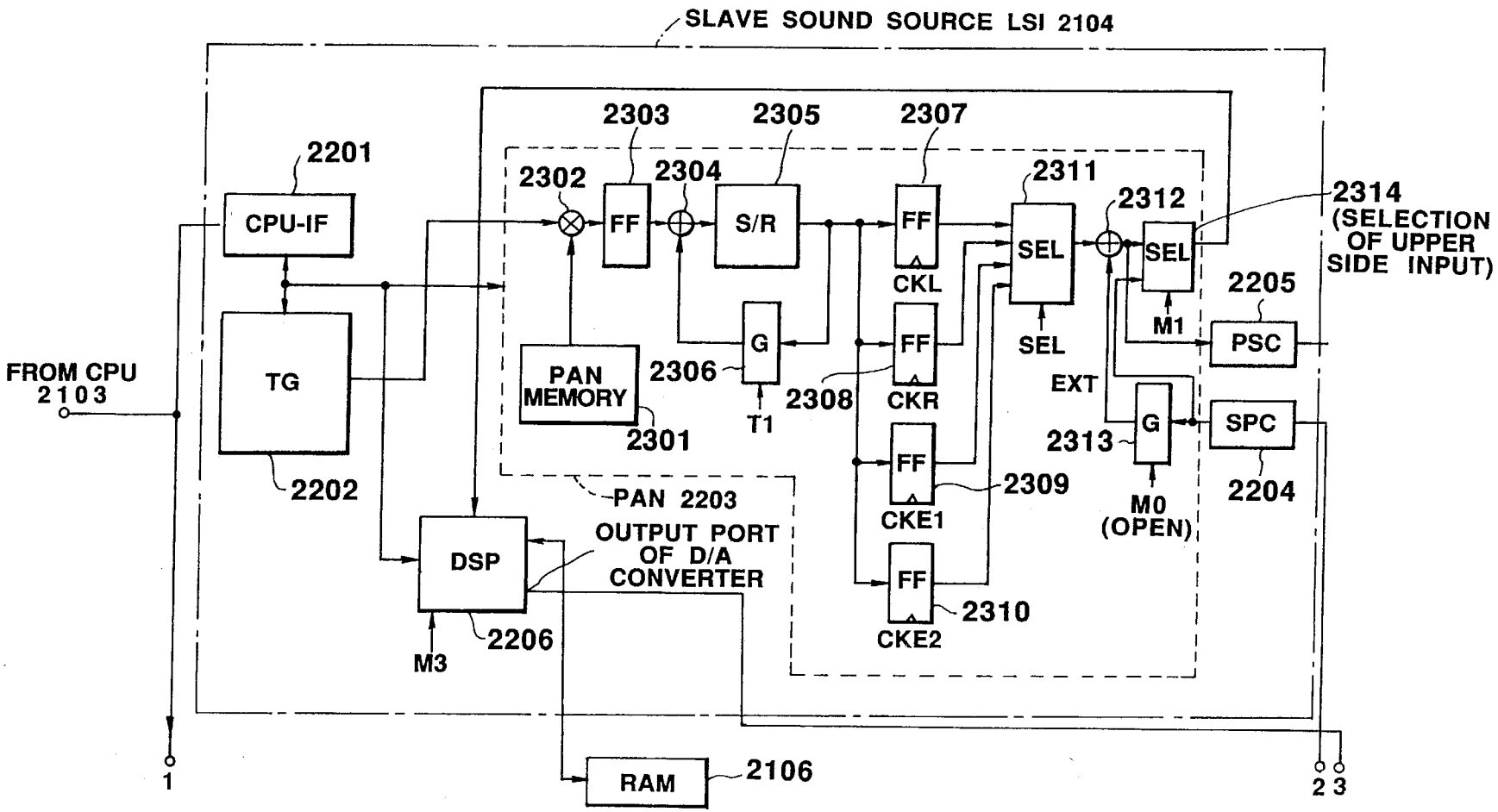
FIG. 13 is a block diagram of structure of a slave sound source LSI 2104 and PAN 2203.
Figure 14:
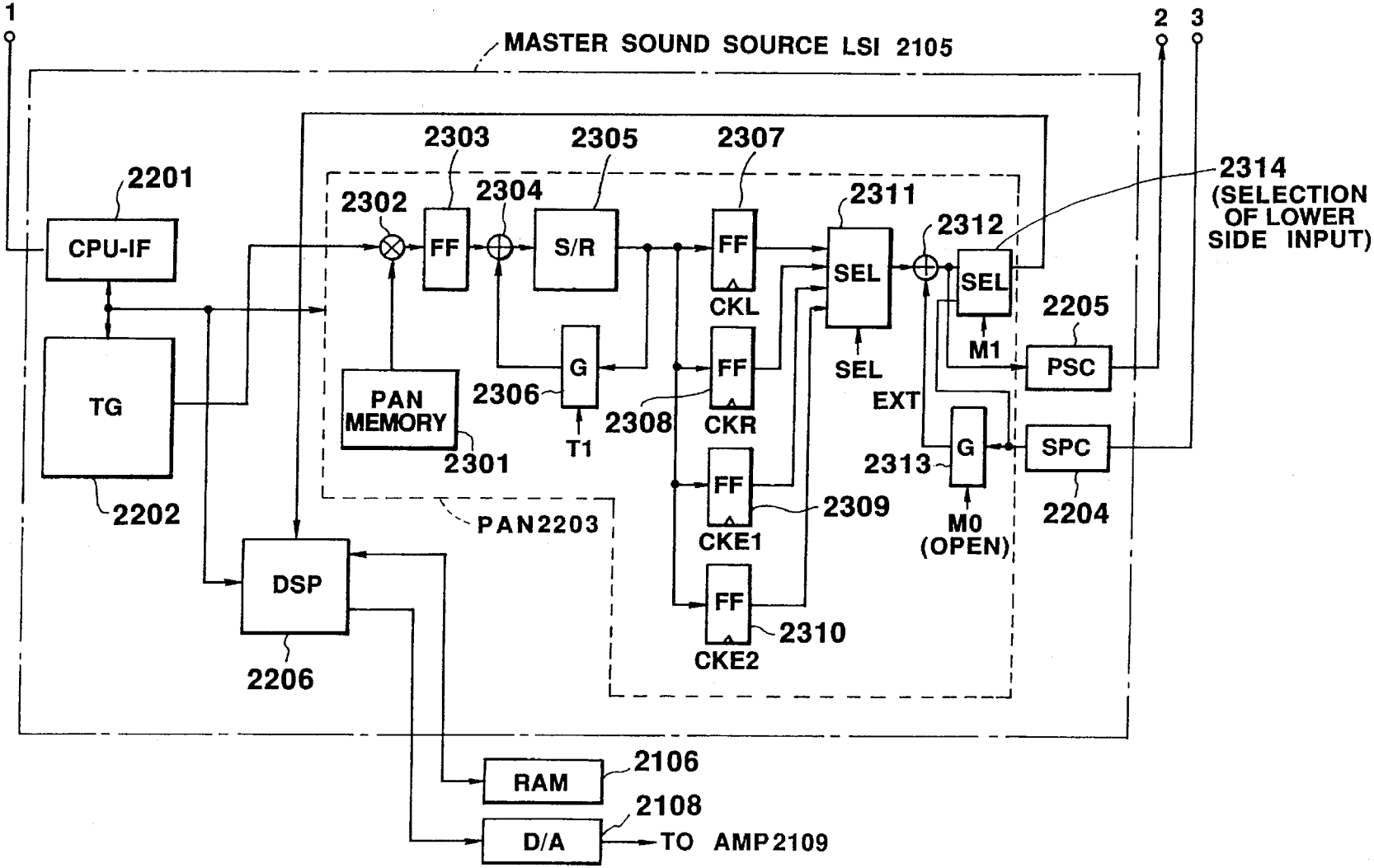
FIG. 14 is a block diagram of structure of a master sound source LSI 2105 and PAN 2203.

FIG. 13 is a block diagram of the whole structure of the slave sound source LSI 2104 including the panning circuit (PAN) 1203. Meanwhile, FIG. 14 is a block diagram of the whole structure of the master sound source LSI 2105. Both the slave and master sound source LSIs 2104, 2105 have the same structure, and are connected with each other at connecting points 1, 2 and 3, as shown in FIGS. 6, 7. These sound source LSIs perform effect processes on musical tone signals generated by the TG 2202 when a gate circuit 2313 and selectors 2311, 2314 are controlled, as will be described later.

The structure and effect processing operation of the sound source LSIs of FIGS. 13 and 14 will be described with reference to time charts of FIGS. 15 and 16.

Figure 15:
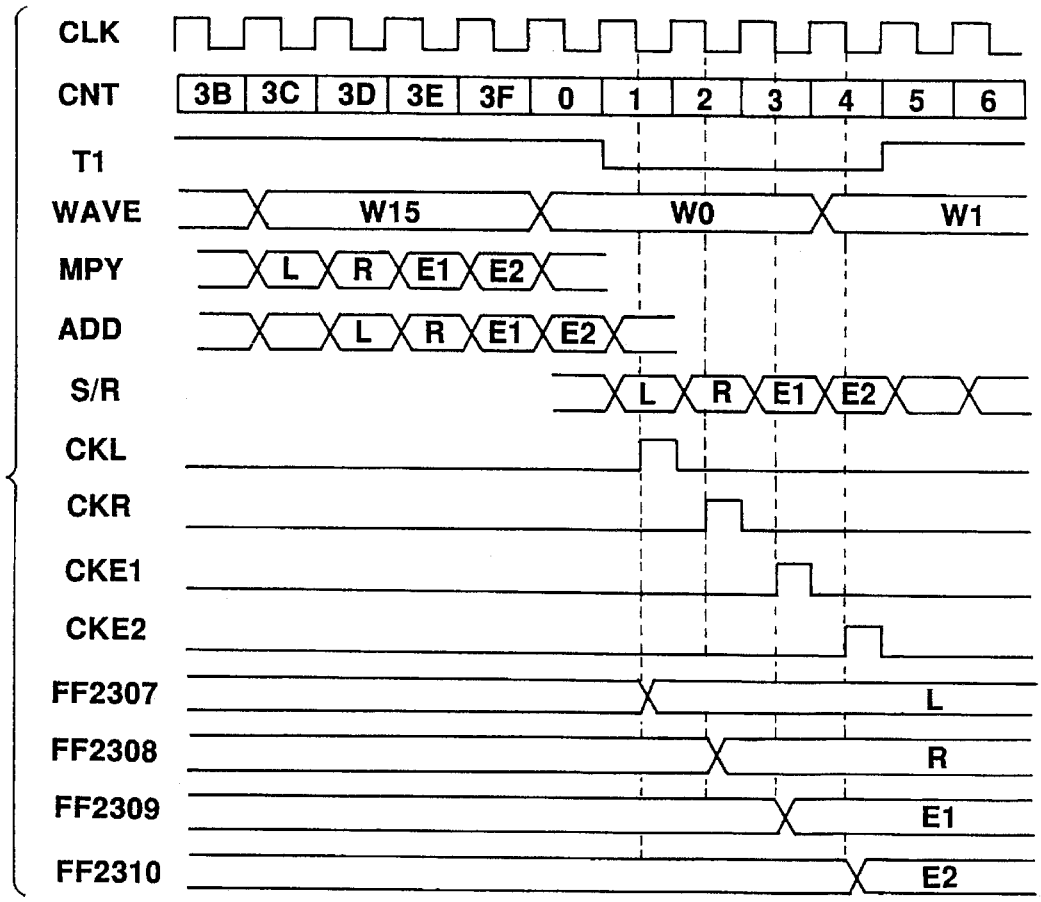
FIG. 15 is a time chart of PAN 2203.

Receiving performance data through the CPU-IF 2201 from the CPU 2103 of FIG. 11, the tone generator TG 2202 of the master sound source LSI 2105 of FIG. 14 generates, in a time sharing manner, musical tone signals which are composed of 16 polyphonic tones having wave heights W15, W0, W1 and so on, shown at "WAVE" of FIG. 15. A "CLK" of FIG. 15 stands for an operation clock signal while "CNT" values of a counter for arithmetic performance timing. One cycle from W0 to W15 corresponds to one sampling period.

A PAN memory 2301 in the PAN 2203 successively outputs coefficient data stored therein, which data are used for weighting four groups of musical tone signals L, R, E1 and E2 for respective 16 channels. The coefficient data are multiplied with musical tone signals for respective channels, which signals are supplied in a time sharing manner from the tone generator TG 2202, as shown at "MPT" of FIG. 15, and the resultant signal is stored in a flip-flop circuit (FF) 2303.

The output of the flip-flop circuit 2303 is added to a feed back signal of a 4-stage shift register S/R 2305, as shown at "ADD" of FIG. 15.

As a result, the resultant accumulations L, R, E1, E2 for respective groups of the musical tone signals (W0 to W15) are output from the shift register S/R 2305, as shown at "S/R" of FIG. 15. Since a gate control signal "T1" varies as shown in FIG. 15, a gate circuit 2306 prevents the shift register S/R 2305 from feeding back the resultant accumulations of the respective musical tone signals (W0 to W15) to the adder 2305 at timings when the shift register S/R 2305 outputs the resultant accumulations.

In accordance with latch clock signals CKL, CKR, CKE1 and CKE2 shown in FIG. 15, flip-flop circuits 2307, 2308, 2309 and 2310 store the resultant accumulations of the respective groups of musical tones output from the shift register S/R 2305, respectively. The latch clock signals CKL, CKR, CKE1 and CKE2 are output at timings of W0 to W1 of "WAVE".

Figure 16:
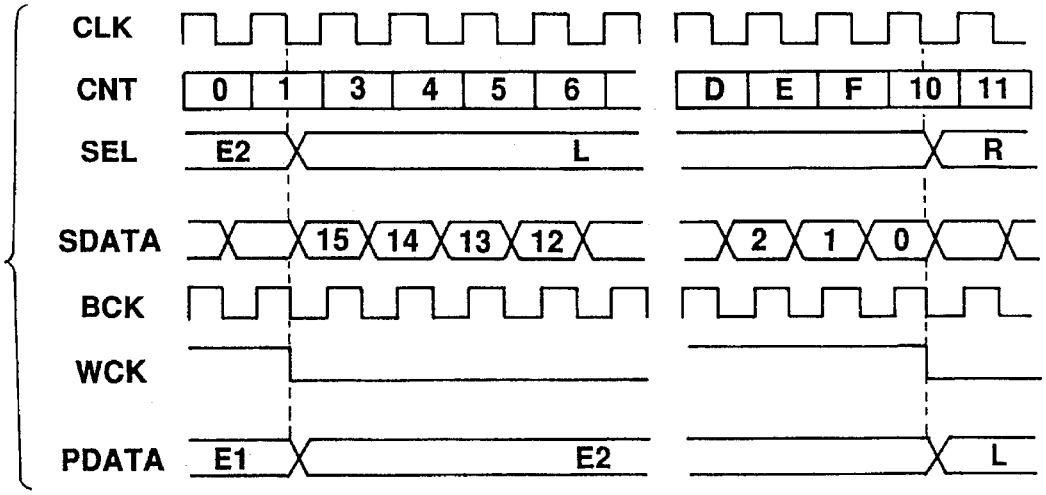
FIG. 16 is a time chart of a parallel/serial conversion in the second embodiment.

Based on a control signal SEL shown at SEL of FIG. 16, the selector SEL 2311 sequentially outputs the resultant accumulations of the respective groups of musical tones stored in the flip-flop circuits 2307 to 2310 during periods, respectively, each of which periods is equivalent to one fourth of one sampling period. The sampling period corresponds to a period from 0 to 3F at CNT of FIG. 15.

The parallel/serial convertor 2205 converts the resultant accumulations received from the selector SEL 2311 into serial data of 16 bits (0 to 15) shown at SDATA of FIG. 16, respectively, based on the a bit clock signal BCK of FIG. 9. The serial data are successively output to the slave sound source LSI 2104 of FIG. 11. It should be noted that the CLK and CNT of FIG. 16 are equivalent to CLK and CNT of FIG. 15, respectively.

In the master sound source LSI 2105 of FIG. 14, a gate circuit 2313 is made closed when a gate signal M0 of a logic "0" is supplied thereto. Therefore, an adder 2312 outputs the output from the selector 2311 without any modification applied thereto. Further, in the master sound source LSI 2105, the selector 2314 selects a lower side input when a control signal M1 of a logic "0" is supplied thereto. Therefore, the output of the adder 2312 is not supplied to the DSP 2206.

In the slave sound source LSI 2104 of FIG. 13, the serial data of the resultant accumulations transferred from the master sound source LSI 2105 are converted into parallel data shown at PDATA in FIG. 16 in accordance with a word clock signal shown at WCK in FIG. 16 by the serial/parallel convertor 2204, and the serial data is input to the gate circuit 1213.

In the slave sound source LSI 2104 of FIG. 13, the gate circuit 2313 is made open when the gate signal M0 of a logic "1" is supplied thereto. Therefore, the parallel data of the resultant accumulations transferred from the master sound source LSI 2105 of FIG. 14 are added to the musical tone signals generated and accumulated in the slave sound source LSI 2105 by the adder 2312.

In the slave sound source LSI 2104, musical tone signals of 16 polyphonic tones generated by the tone generator TG 2202 are accumulated into four groups L, R, E1 and E2 in a similar manner to that in the master sound source LSI 2105.

It will be understood when SEL is compared with PDATA in FIG. 16 that the resultant accumulations of the master sound source LSI 2105 are delayed by one group (word) while they are transferred from the master sound source LSI 2105 to the slave sound source LSI 2104.

Accordingly, the musical tone signals of the master sound source LSI 2105 and the musical tone signals of the slave sound source LSI 2104, which are shifted in timing by one word, will be added together. Therefore, the accumulating operation of musical tone signals will be performed in the slave sound source LSI 2104 at a timing which is delayed by one group (word) compared with that in the master sound source LSI 2105. For that purpose, a coefficient which is delayed by one group timing compared with that of the master sound source LSI 2105 is previously written into the PAN memory 2301 of the slave sound source LSI 2104.

In the slave sound source LSI 2104 of FIG. 13, the selector 2314 selects an upper side input when the control signal M1 of a logic "1" is supplied thereto. Therefore, the resultant sum of the adder 2312 is transferred to the DSP 2206.

The resultant sum of the adder 2312 transferred to the DSP 2201 is subjected to the effect process with the aid of the external RAM 2106 of FIG. 11 as the delay memory.

Figure 17:
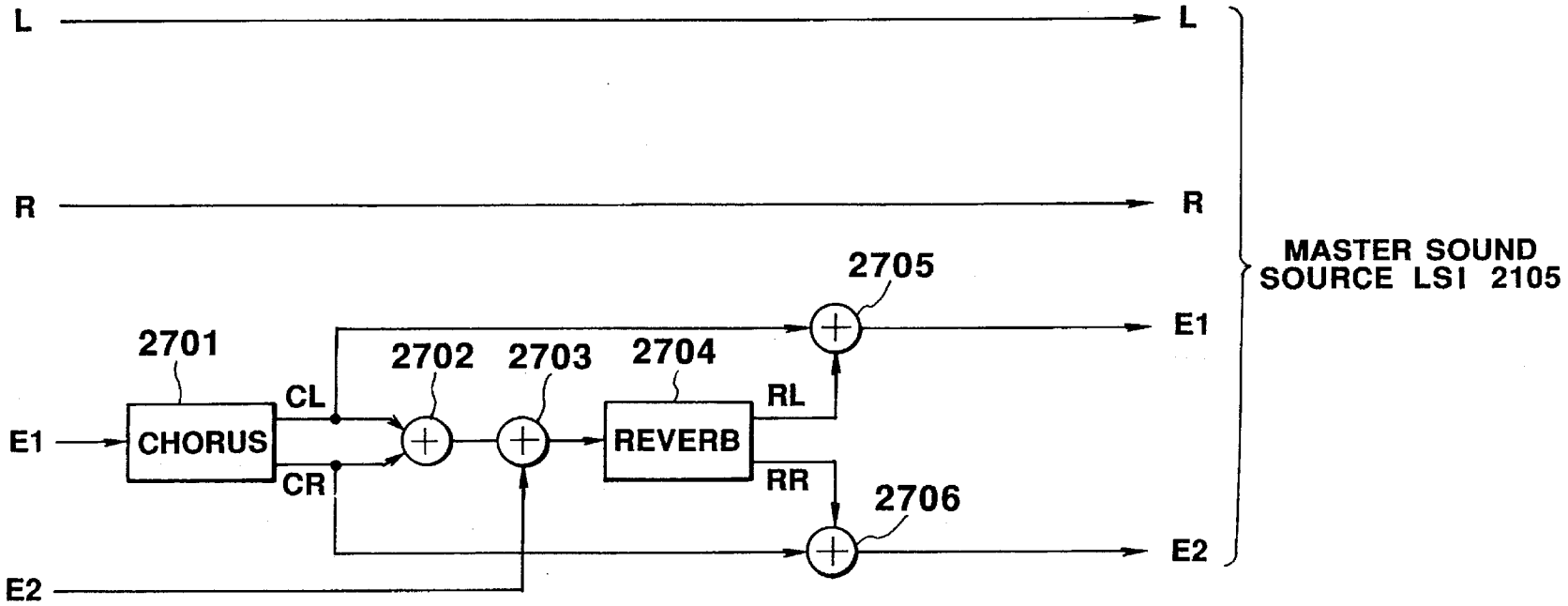
FIG. 17 is a functional block diagram showing an example of an effect process of DSP 2206 in the slave sound source LSI 2104.

In FIG. 17 is shown an example of a functional block diagram of the effect process performed by the DSP 2206 in the slave sound source LSI 2104 of FIG. 13. In FIG. 17, as described above, L, R, E1 and E2 stand for accumulated values of four groups of musical tone signals, respectively.

A chorus adding unit 2701 adds a chorus effect to the musical tone signal E1, thereby developing a left component signal CL and a right component signal CR. These component signals CR, CL are supplied to adders 2705 and 2706, respectively, and are added together by an adder 2702 at the same time.

The output of the adder 2702 is added to the musical tone signal E2 by an adder 2703. The resultant signal is further supplied to a reverberation adding unit 2704. The reverberation adding unit 2704 adds a reverberation effect to the received signal, thereby developing a left component signal RL and a right component signal RR. These component signals RL, RR are added to the component signals CL, CR transferred from the chorus adding unit 2701 by the adders 2705 and 2706, respectively.

In this fashion, the musical tone signals E1, E2 are subjected to the effect process in the chorus effect adding unit 2701 and the reverberation adding unit 2704. In FIG. 17, the effect process will be performed in four manners in accordance with combination of values of the musical tone signals:

(1) E1=0 and E2 ≠0: only reverberation effect is added.

(2) E1 ≠0 and E2=0: chorus and reverberation effects are added.

(3) E1 ≠0 and E2 ≠0: chorus and reverberation effects are added.

(4) E1=0 and E2=0: none of chorus and reverberation effects is added.

Amplitudes of the signals E1, E2 are controlled in accordance with coefficients for the signals E1, E2 stored in the PAN memory 2301.

The outputs of the adders 2705 and 2706 are output as new musical tone signals E1, E2, respectively.

Meanwhile, the musical tone signals L, R are output without being subjected to any process.

The above four groups of musical tone signals L, R, E1 and E2 are converted into serial signal by the DSP 2206, and transferred from the output port of the D/A convertor in the DSP 2206 to the master sound source LSI 2105.

In the master sound source LSI 2105 of FIG. 14, the serial data of the four groups of musical tone signals subjected to the effect process are converted into parallel data PDATA of FIG. 16 on the basis of the word clock signal WCK of FIG. 16 by the serial/parallel convertor 2204.

In the master sound source LSI 2105 of FIG. 14, the selector 2314 selects a lower side input when a control signal M1 of a logic "0" is supplied thereto. Therefore, the output of the serial/parallel converter 2204 is selected by the selector 2314 and transferred to the DSP 2206.

The four groups of musical tone signals which have been subjected to the effect process in the DSP 2206 of the slave sound source LSI 2104 of FIG. 13, and which are transferred to the DSP 2206 of the master sound source LSI 2105 of FIG. 14, are further subjected to the effect process with the aid of the external RAM 2107 of FIG. 11.

Figure 18:
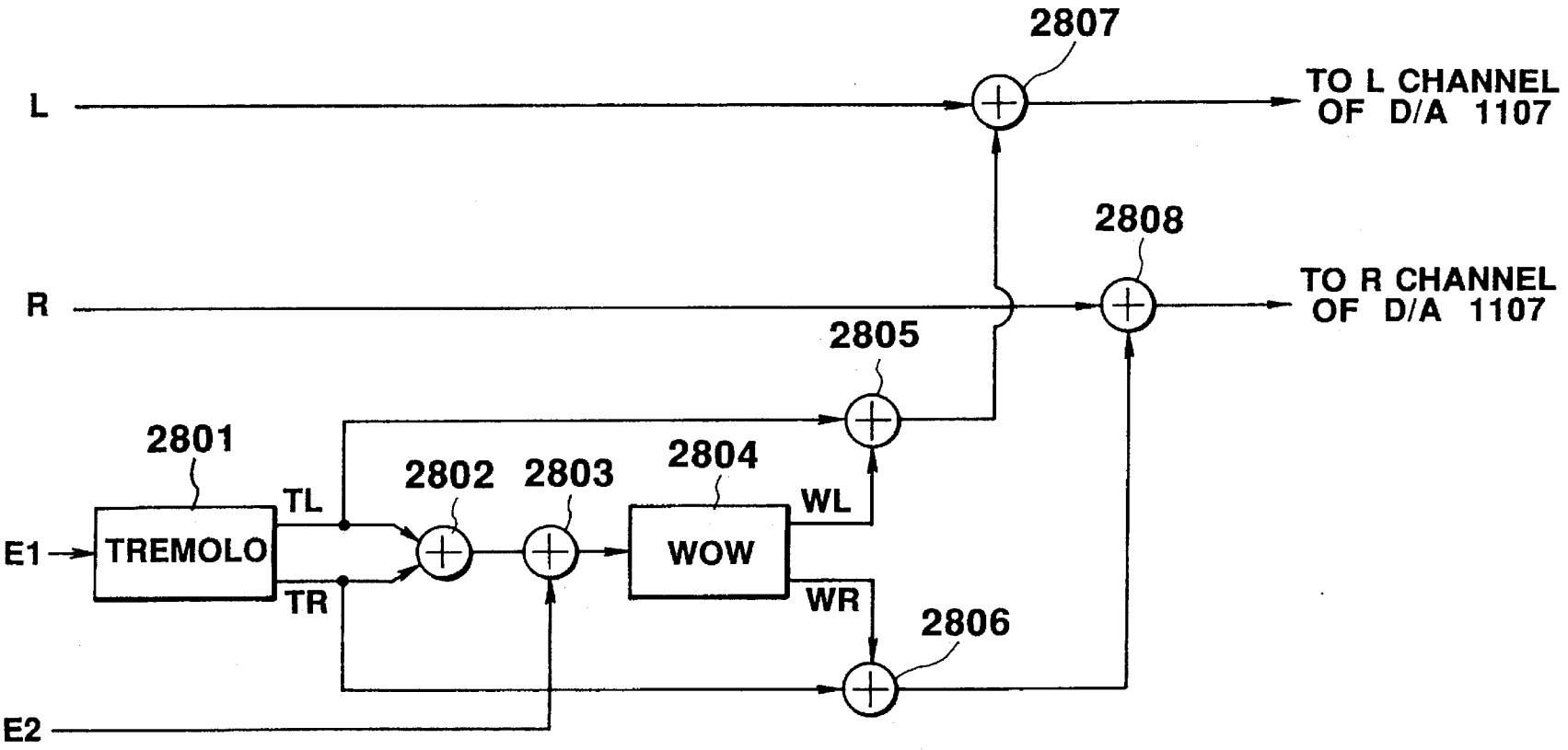
FIG. 18 is a functional block diagram showing an example of an effect process of DSP 2206 in the master sound source LSI 2105.

In FIG. 18 is shown an example of a functional block diagram of the effect process performed by the DSP 2206 in the master sound source LSI 2105 of FIG. 14. In FIG. 18, as described above, L, R, E1 and E2 stand for accumulated values of four groups of musical tone signals transferred from the slave sound source LSI 2104.

A tremolo adding unit 2801 adds a tremolo effect to the musical tone signal E1, thereby developing a left component signal TL and a right component signal TR. These component signals TR, TL are supplied to adders 2805 and 2806, respectively, and are added together by an adder 2802 at the same time.

The output of the adder 2802 is added to the musical tone signal E2 by an adder 2803. The resultant signal is further supplied to a wow adding unit 2804. The wow adding unit 2804 adds a wow effect to the received signal, thereby developing a left component signal WL and a right component signal WR.

These component signals WL, WR are added to the component signals TL, TR transferred from the tremolo adding unit 2801 by the adders 2805 and 2806, respectively. The resultant signals are sent to adders 2807, 2808.

The musical tone signals E1, E2, which have been subjected to the effect process in the above mentioned manner, are added to the left component musical tone signal L and the right component musical tone signal R by adders 2807, 2808, respectively. The resultant signals are sent as a left channel signal and a right channel signal to the D/A convertor 2108, thereby being converted into analog signals. The analog signals are audibly output as effect added signals through the amplifier 2109 and the speakers 2110.

As described above, the master sound source LSI 2105 generates musical tone signals and accumulates these musical tone signals into four groups. The four groups of musical tone signals are supplied to the slave sound source LSI 2104. The slave sound source LSI 2104 generates musical tone signals and accumulates these musical tone signals into four groups, thereby developing respective accumulated values. The slave sound source LSI 2104 adds the accumulated values to the four groups of musical tone signals supplied from the master sound source LSI 2104, and performs the effect process on the resultant signals. The musical tone signals subjected to the effect process in the slave sound source LSI 2104 are sent back to the master sound source LSI 2105 again to be subjected to another effect process.

The musical tone signals, which are added with chorus and reverberation effect in the DSP 2206 of the slave sound source LSI 2104, are further added with the tremolo and wow effects in the DSP 2206 of the master sound source LSI 2105.

In the second embodiment described above, two chips of sound source LSIs are employed, but more than two chips of LSIs or an arbitrary number of chips of LSIs may be used in the embodiment of the present invention.

Figure 19:
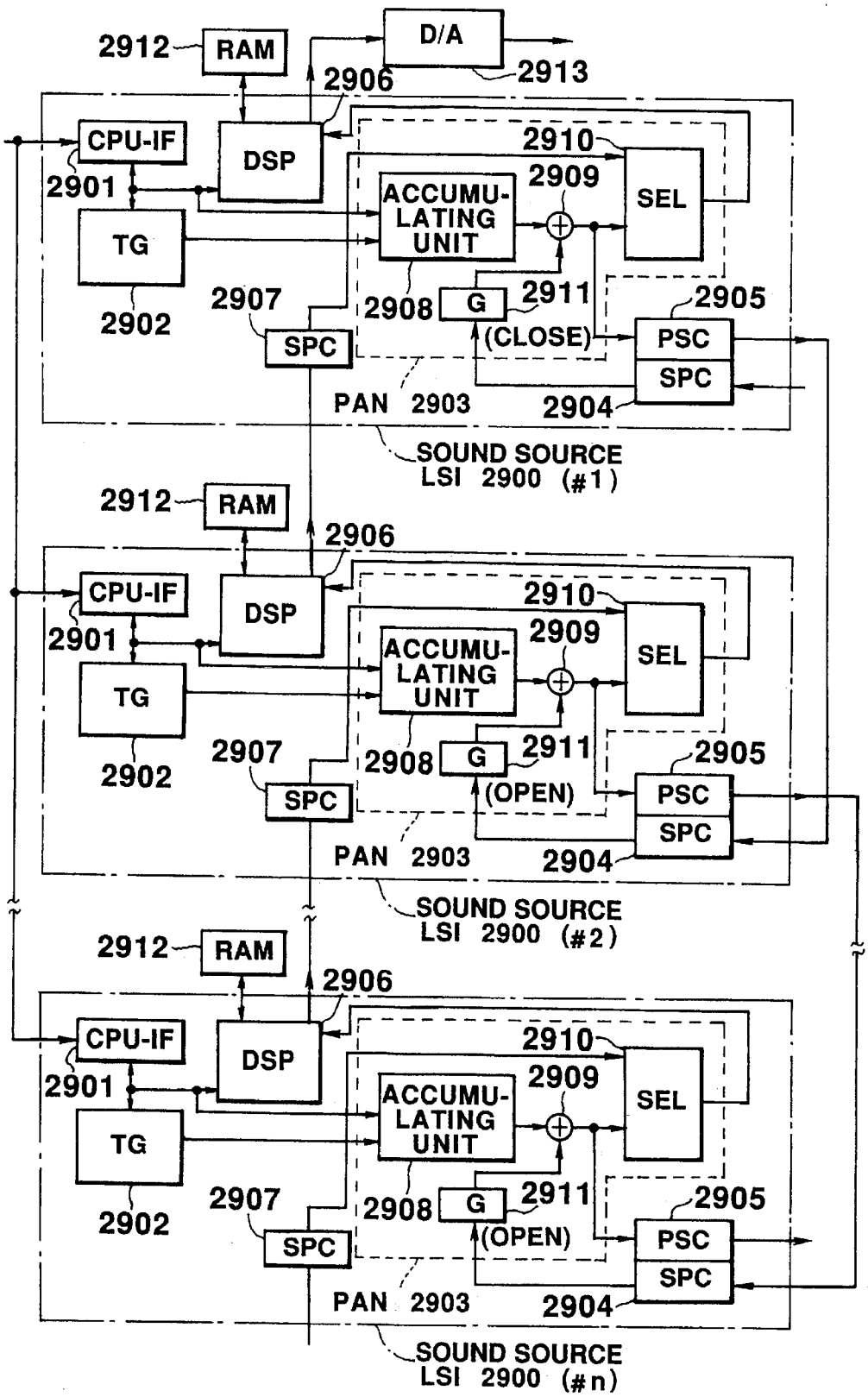
FIG. 19 is a schematic diagram showing other embodiment of the present invention.

FIG. 19 is a view showing schematic structure of another embodiment of the present invention, in which n (n: an integer) chips of LSIs 2900 (#1 to #n) are used.

Components 2901 to 2906 shown in FIG. 19 are similar to those of FIGS. 12 to 14. In FIG. 19, the sound source LSIs 2900 #1 to #n correspond to the sound source LSI 2105, a RAM 2912 to the RAM 2106 or the RAM 2107, a D/A convertor 2913 to the D/A convertor 2108, an adder 2909 to the adder 2312, a selector (SEL) 2910 to the selector 2314 and a gate circuit (G) 2911 to the gate circuit 2313, respectively. An accumulating unit 2908 has a function similar to the function which is performed by components 2301 to 2311 in FIG. 13 or 14.

The embodiment of FIG. 19 is different from the second embodiment of FIGS. 12 to 14 in the following points: In the second embodiment, the serial/parallel convertors SPC 2204 in the respective sound source LSIs are arranged such that they have a function of receiving the accumulated values sent from a previous stage of sound source LSI (a master sound source LSI), and further have a function of receiving the output of the DSP sent from a previous stage of sound source LSI (a slave sound source LSI). Meanwhile, in the embodiment of FIG. 19, the sound source LSI 2900 is arranged such that the serial/parallel convertor SPC 2904 receives the accumulated values sent from the previous stage of sound source LSI (the master sound source LSI), and further the serial/parallel convertor 2907 receives accumulated values sent from a previous stage of sound source LSI (the slave sound source LSI). Accordingly, in the embodiment of FIG. 19, mixture of accumulated outputs of a plurality of sound source LSIs 2900 may performed independently of connection of the respective DSPs 2906.

In FIG. 19, only the SEL 2910 of the sound source LSI of #n 2900 is set so as to select an input to a lower terminal from the adder 2902, and the respective selectors 2910 of the sound source LSIs other than the sound source LSI of #n are set so as to select inputs to upper terminals from the serial/parallel convertors 2907. Further, only the gate circuit 2911 in the sound source LSI of #1 2900 is set so as to close to prevent the input from the serial/parallel convertor 2904 from entering while the gate circuit 2911 of the sound source LSIs 2900 other than the sound source LSI of #1 2900 is set so as to open to allow the input from the serial/parallel convertor 2904 to enter.

Accordingly, the accumulated outputs developed within the sound source LSI of #1 2900 are transferred to the sound source LSI of #2 2900 through the adder 2909 and the parallel/serial convertor 2905.

In the sound source LSI of #2 2900, the accumulated outputs of the sound source LSI of #1 2900 are transferred from the serial/parallel convertor 2904 through the gate circuit 2911 to the adder 2909, where the accumulated outputs transferred thus are mixed with the accumulated outputs developed within the sound source LSI of #2 2900. The resultant accumulated outputs are transferred through the adder 2909 and the parallel/serial convertor 2905 to the following stage of sound source LSI of #3 2900.

Thereafter, in the respective stages of sound source LSIs 2909, the adders 2909 mixes the accumulated outputs transferred from the previous stage of sound source LSI 2900 with the accumulated outputs developed within itself. The resultant accumulated outputs are transferred to the following stage of sound source LSI 2900 through the adder 2909 and the parallel/serial convertor 2905.

In the sound source LSI of #n 2909, the adders 2909 mixes the accumulated outputs transferred from the previous stage of sound source LSI 2900 with the accumulated outputs developed within itself. The resultant accumulated outputs are transferred from the adder 2909 through the selector 2910 to the DSP 2906. The DSP 2906 performs an effect process on the resultant accumulated outputs, using the RAM 2912 as a work area. The resultant DSP outputs are transferred to the previous stage of sound source LSI 2900.

Thereafter, in the respective sound source LSIs 2900, the DSP output is transferred in an opposite direction to that of the accumulated outputs, i.e., the DSP output transferred from the following stage of sound source LSI 2900 is input to the serial/parallel convertor 2907 of the previous sound source LSI 2900, and further transferred through the selector 2910 to the DSP 2906. In the DSP 2906, the DSP output is subjected to an effect process. The resultant DSP output is further transferred to the serial/parallel convertor 2907 of the previous stage of sound source LSI 2900.

In the sound source LSI of #1 2900, the serial/parallel convertor 2907 receives the 2DSP output from the sound source LSI of #2 2900, and transfers the DSP output through the selector 2910 to the DSP 2906, where the DSP output is subjected to the final effect process. Then, the resultant DSP output is output to the D/A convertor 2913.

As described above, the accumulated outputs of the respective sound source LSIs 2900 can be mixed with the accumulated outputs of the following stage of sound source LSI 2900, and the DSPs 2906 of the respective sound source LSIs 2900 can be connected with each other independently of the mixture of the accumulated outputs.

With the structure of the sound source integrated-circuits according to the seventh and ninth aspects of the present invention, the musical tone signal generated within the sound source integrated-circuit and the musical tone signal externally generated can efficiently be subjected to an effect adding process, and the resultant effect added musical tone signal is transferred to another sound source integrated-circuit, where the signal can be subjected to another effect process. Therefore, a combination of a plurality of sound source integrated-circuits will allow an effect adding process of a high degree to be performed on a musical tone signal without the aid of a valuable circuit, of high performance, specialized for a digital signal processing.

With the structure of the sound source integrated-circuits according to the eighth and tenth aspects of the present invention, the sound source integrated-circuits of the same structure can be connected in cascade. Therefore, musical tone signals generated in the respective sound source integrated-circuits can successively be mixed, thereby a complex musical tone signal being developed, and the mixed musical tone signals can successively be subjected to an effect adding process at the same time. As a result, manufacturing costs of an effect adding system can be reduced, and a compact sized system can be realized.

With the structure of the sound source integrated-circuits according to the eighth and tenth aspects of the present invention, a not valuable sound source integrated-circuit may be used for performing a signal process of high performance such as a stereophonic signal process, when the integrated-circuit is provided with elements for classifying musical tone signals into plural groups and processing the classified musical tone signals.

Several embodiments of the present invention have been described in detail but these embodiments are simply illustrative and not restrictive. The present invention may be modified in various manners. All the modifications and applications of the present invention will be within the scope and spirit of the invention, so that the scope of the present invention should be determined only by what is recited in the present appended claims and their equivalents.

What is claimed is:

1. A single chip sound source integrated-circuit including an effect adding device, comprising:

musical tone signal generating means, on said single chip, for generating a musical tone signal;

input means for entering a musical tone signal which is externally supplied thereto;

mixing means, on said single chip, for mixing the musical tone signal generated by said musical tone signal generating means with the musical tone signal entered by said input means to generate a mixed signal;

effect adding means, on said single chip, for adding a sound effect to the mixed signal generated by and received from said mixing means to generate an effect-added signal; and output means for externally outputting the effect-added signal generated by and received from said effect adding means.

2. A single chip sound source integrated-circuit according to claim 1, wherein:

said musical tone signal generating means generates a musical tone signal as parallel data; and said input means includes a serial/parallel converter for receiving a musical tone signal in the form of serial data externally supplied thereto, and for converting the received musical tone signal into a parallel data signal so as to be in a form to be processed within the single chip sound source integrated-circuit.

3. A single chip sound source integrated-circuit including an effect adding device, comprising:

musical tone signal generating means, on said single chip, for generating a musical tone signal;

input means for entering a musical tone signal which is externally supplied thereto;

mixing means, on said single chip, for mixing the musical tone signal generated by said musical tone signal generating means with the musical tone signal entered by said input means to generate a mixed signal;

effect adding means, on said single chip, for adding a sound effect to the mixed signal generated by and received from said mixing means to generate an effect-added signal;

first output means for externally outputting the effect-added signal generated by and received from said effect adding means; and second output means for externally outputting the mixed signal generated by and received from said mixing means.

4. A single chip sound source integrated-circuit according to claim 3, wherein:

said musical tone signal generating means generates a musical tone signal as parallel data; and said input means includes a serial/parallel converter for receiving a musical tone signal in the form of serial data externally supplied thereto, and for converting the received musical tone signal into a parallel data signal so as to be in a form to be processed within the single chip sound source integrated-circuit.

5. A single chip sound source integrated-circuit according to claim 4, wherein said second output means includes a parallel/serial converter for converting a mixed signal in the form of parallel data received from said mixing means into a serial data signal, and for externally outputting the serial data signal.

6. A sound source apparatus comprising:

multiple stages of sound source integrated-circuits connected in cascade each of, said multiple stages of said sound source integrated-circuits being on a respective different single chip, and each of said sound source integrated-circuits including:

musical tone signal generating means, on said single chip, for generating a musical tone signal;

input means for entering a signal which is externally supplied thereto;

mixing means, on said single chip, for mixing the musical tone signal generated by said musical tone signal generating means with the signal entered by said input means to generate a mixed signal;

effect adding means, on said single chip, for adding sound effect to the mixed signal generated by and received from said mixing means to generate an effect-added signal;

first output means for outputting the effect-added signal generated by and received from said effect adding means; and second output means for outputting the mixed signal generated by and received from said mixing means, wherein said second output means of the respective stages of the sound source integrated-circuits are connected to input means of following stages of sound source integrated-circuits to transfer the mixed signals generated by said mixing means, and said first output means of a last stage of the sound source integrated-circuits externally outputs an effect-added signal received from the effect adding means of the last stage of the sound source integrated-circuits.

7. A single chip sound source apparatus according to claim 6, wherein:

said musical tone signal generating means generates a musical tone signal as parallel data; and said input means includes a serial/parallel converter for receiving a musical tone signal in the form of serial data supplied thereto, and for converting the received musical tone signal into a parallel data signal so as to be in a form to be processed within the single chip sound source integrated-circuit.

8. A single chip sound source apparatus according to claim 7, wherein said second output means includes a parallel/serial converter for converting a mixed signal in the form of parallel data received from said mixing means into a serial data signal, and for outputting the serial data signal.

9. A single chip sound source integrated-circuit including an effect adding device, comprising:

musical tone signal generating means, on said single chip, for generating a plurality of time-shared musical tone signals;

input means for entering musical tone signals which are externally supplied thereto, the musical tone signals comprising a plurality of signal groups;

grouping means, on said single chip, for grouping the plurality of time-shared musical tone signals generated by said musical tone signal generating means into a same number of signal groups as those of the musical tone signals which are externally supplied to said input means;

mixing means, on said single chip, for mixing respective signal groups of the time-shared musical tone signals grouped by said grouping means with corresponding signal groups of said musical tone signals entered by said input means, respectively, to generate a plurality of signal groups of mixed signals;

effect adding means, on said single chip, for adding a sound effect to the respective signal groups of mixed signals generated by and received from said mixing means to generate effect-added signals; and output means for externally outputting the effect added signals generated by and received from said effect adding means.

10. A single chip sound source integrated-circuit according to claim 9, wherein:

said musical tone signal generating means generates said time-shared musical tone signals as parallel data signals; and said input means includes a serial/parallel converter for receiving musical tone signals in the form of serial data signals which are externally supplied thereto, and for converting the received musical tone signals into parallel data signals so as to be in a form to be processed within the single chip sound source integrated-circuit.

11. A single chip sound source integrated-circuit including an effect adding device, comprising:

musical tone signal generating means, on said single chip, for generating a plurality of time-shared musical tone signals;

input means for entering musical tone signals which are externally supplied thereto, the musical tone signals being grouped into a plurality of signal groups;

grouping means, on said single chip, for grouping the plurality of time-shared musical tone signals generated by said musical tone signal generating means into a same number signal groups as those of the musical tone signals which are externally supplied to said input means;

mixing means, on said single chip, for mixing respective signal groups of the time-shared musical tone signals grouped by said grouping means with corresponding signal groups of the musical tone signals received from said input means, to generate a plurality of signal groups of mixed signals;

effect adding means, on said single chip, for adding a sound effect to the respective signal groups of mixed signals generated by and received from said mixing means to generate effect-added signals;

first output means for externally outputting the effect-added signals generated by and received from said effect adding means; and second output means for externally outputting the plurality of signal groups of mixed signals generated by and received from said mixing means.

12. A single chip sound source integrated-circuit according to claim 11, wherein:

said musical tone signal generating means generates said musical tone signals as parallel data signals; and said input means includes a serial/parallel converter for receiving musical tone signals in the form of serial data signals which are externally supplied thereto, and for converting the received musical tone signal into parallel data signals so as to be in a form to be processed within the single chip sound source integrated-circuit.

13. A single chip sound source integrated-circuit according to claim 12, wherein said second output means includes a parallel/serial converter for converting mixed parallel data signals received from said mixing means into serial data signals, and for externally outputting the serial data signals from said second output means.

14. A sound source apparatus comprising:

multiple stages of sound source integrated-circuits connected in cascade, each of said multiple stages of sound source integrated-circuits being on a respective different single chip, and each of said sound source integrated-circuits including:

musical tone signal generating means, on said single chip, for generating a plurality of time-shared musical tone signals;

input means for entering musical tone signals which are externally supplied thereto, the musical tone signals being grouped into a plurality of signal groups;

grouping means for grouping the plurality of time-shared musical tone signals generated by said musical tone signal generating means into a same number of signal groups as those of the musical tone signals which are externally supplied to said input means;

mixing means, on said single chip, for mixing respective signal groups of the time-shared musical tone signals grouped by said grouping means with corresponding signal groups of the musical tone signals received from said input mean, to generate a plurality of signal groups of mixed signals;

effect adding means, on said single chip, for adding a sound effect to the respective signal groups of mixed signals generated by and received from said mixing means to generate effect-added signals;

first output means for outputting effect-added signals generated by and received from said effect adding means; and second output means for outputting the respective signal groups of mixed musical tone signals generated by and received from said mixing means;

wherein said second output means of the respective stages of the sound source integrated-circuits are connected to input means of following stages of sound source integrated-circuits for transferring the mixed musical tone signals, and said first output means of a last stage of the sound source integrated-circuits externally outputs effect-added signals.

15. A sound source apparatus according to claim 14, wherein:

said musical tone signal generating means generates said musical tone signals as parallel data signals; and said input means includes a serial/parallel converter for receiving musical tone signals in the form of serial data signals which are externally supplied thereto, and for converting the received musical tone signals into parallel data signals so as to be in a form to be processed within the sound source integrated-circuit.

16. A sound source apparatus according to claim 15, wherein said second output means includes a parallel/serial converter for converting the mixed parallel data signals received from said mixing means into serial data signals, and for outputting the serial data signals.

17. A single chip sound source integrated-circuit including an effect adding device, comprising:

musical tone signal generating means, on said single chip, for generating a musical tone signal;

first input means for entering a first musical tone signal which is externally supplied thereto;

mixing means, on said single chip, for mixing the musical tone signal generated by said musical tone signal generating means with the first musical tone signal received from said first input means to generate a mixed signal;

second input means for entering a second musical tone signal which is externally supplied thereto;

selecting means for selecting either of the mixed signal supplied from said mixing means and the second musical tone signal supplied from said second input means;

effect adding means, on said single chip, for adding a sound effect to the signal selected by said selecting means to generate an effect-added signal; and output means for externally outputting the effect added signal generated by and received from said effect adding means.

18. A single chip sound source integrated-circuit according to claim 17, wherein:

said musical tone signal generating means generates a musical tone signal as a parallel data signal; and said first and second input means each include a serial/parallel converter for receiving a musical tone signal as a serial data signal which is externally supplied thereto, and for converting the received serial data musical tone signal into a parallel data signal so as to be in a form to be processed within the single chip sound source integrated-circuit.

19. A single chip sound source integrated-circuit including an effect adding device, comprising:

musical tone signal generating means, on said single chip, for generating a musical tone signal;

first input means for entering a first musical tone signal which is externally supplied thereto;

mixing means, on said single chip, for mixing the musical tone signal generated by said musical tone signal generating means with the first musical tone signal received from said first input means to generate a mixed signal;

second input means for entering a second musical tone signal which is externally supplied thereto;

selecting means for selecting either of the mixed signal generated by said mixing means and the second musical tone signal supplied from said second input means;

effect adding means, on said single chip, for adding a sound effect to the signal selected by said selecting means to generate an effect-added signal;

first output means for externally outputting the effect-added signal generated by and received from said effect adding means; and second output means for externally outputting the mixed signal generated by and received from said mixing means.

20. A single chip sound source integrated-circuit according to claim 19, wherein:

said musical tone signal generating means generates a musical tone signal as a parallel data signal; and said first input means includes a serial/parallel converter for receiving a first musical tone signal as a serial data signal which is externally supplied thereto, and for converting the received serial data musical tone signal into a parallel data signal so as to be in a form to be processed within the single chip sound source integrated-circuit; and said second input means includes a serial/parallel converter for receiving a second musical tone signal as a serial data signal which is externally supplied thereto, and for converting the received serial data musical tone signal into a parallel data signal so as to be in a form to be processed within the single chip sound source integrated-circuit.

21. A single chip sound source integrated-circuit according to claim 20, wherein:

said second output means includes a parallel/serial converter for converting the parallel data mixed signal received from said mixing means into a serial data signal, and for externally outputting the serial data signal; and said effect adding means includes a serial output means for outputting its own output as a serial data signal.

22. A single chip sound source integrated-circuit including an effect adding device, comprising:

musical tone signal generating means, on said single chip, for generating a plurality of time-shared musical tone signals;

first input means for entering first musical tone signals which are externally supplied thereto, the first musical tone signals being grouped into a plurality of signal groups;

grouping means for grouping the plurality of time-shared musical tone signals generated by said musical tone signal generating means into a same number of signal groups as those of the first musical tone signals which are externally supplied to said first input means;

mixing mean, on said single chip, for mixing the respective signal groups of the time-shared musical tone signals grouped by said grouping means with corresponding signal groups of the first musical tone signals received from said first input means, to generate a plurality of signal groups of mixed signals;

second input means for entering second musical tone signals which are supplied thereto, the second musical tone signals being grouped into the same number of signal groups as those of the first musical tone signals;

selecting means for selecting either of the plurality of signal groups of mixed signals and the plurality of signal groups of second musical tone signals received from said second input means;

effect adding means, on said single chip, for adding a sound effect to the plurality of signal groups of signals selected by said selecting means to generate effect-added signals; and output means for externally outputting the effect added signals generated by and received from said effect adding means.

23. A single chip sound source integrated-circuit according to claim 22, wherein:

said musical tone signal generating means generates a time-shared musical tone signal as a parallel data signal; and said first input means includes a serial/parallel converter for receiving first serial data musical tone signals which are externally supplied thereto, and for converting the received first musical tone signals into parallel data signals so as to be in a form to be processed within the single chip sound source integrated-circuit; and said second input means includes a serial/parallel converter for receiving second serial data musical tone signals which are externally supplied thereto, and for converting the received second musical tone signal into parallel data signals so as to be in a form to be processed within the single chip sound source integrated-circuit.

24. A single chip sound source integrated-circuit including an effect adding device, comprising:

musical tone signal generating means, on said single chip, for generating a plurality of time-shared musical tone signals;

first input means for entering first musical tone signals which are externally supplied thereto, the first musical tone signals being grouped into a plurality of signal groups;

grouping means for grouping the plurality of time-shared musical tone signals generated by said musical tone signal generating means into a same number of signal groups as those of the first musical tone signals which are externally supplied to said first input means;

mixing means, on said single chip, for mixing respective signal groups of the time-shared musical tone signals grouped by said grouping means with corresponding signal groups of the first musical tone signals received from said first input means, to generate a plurality of signal groups of mixed signals;

second input means for entering second musical tone signals which are externally supplied thereto, the second musical tone signals being grouped into the same number of signal groups as those of the first musical tone signals;

selecting means for selecting either of the plurality of signal groups of mixed signals supplied from said mixing means and the plurality of signal groups of second musical tone signals received from said second input means;

effect adding means, on said single chip, for adding a sound effect to the plurality of signal groups of signals selected by said selecting means to generate effect-added signals;

first output means for externally outputting the effect-added signals generated by and received from said effect adding means; and second output means for externally outputting the plurality of signal groups of mixed signals generated by and received from said mixing means.

25. A single chip sound source integrated-circuit according to claim 24, wherein:

said musical tone signal generating means generates time-shared musical tone signals as parallel data signals;

said first input means includes a serial/parallel converter for receiving first parallel data musical tone signals which are externally supplied thereto, and for converting the received first musical tone signals into parallel data signals so as to be in a form to be processed within the single chip sound source integrated-circuit; and said second input means includes a serial/parallel converter for receiving second musical tone signals as serial data signals which are externally supplied thereto, and for converting the received second musical tone signals into parallel data signals so as to be in a form to be processed within the signal chip sound source integrated-circuit.

26. A single chip sound source integrated-circuit according to claim 25, wherein:

said second output means includes parallel/serial converting means for converting mixed parallel data signals received from said mixing means into serial data signals, and for externally outputting the serial data signals; and said effect adding means includes serial output means for outputting its own output as a serial data signal.

* * * * *

UNITED STATES PATENT AND TRADEMARK OFFICE

CERTIFICATE OF CORRECTION

PATENT NO. : 5,541,360
DATED : July 30, 1996
INVENTOR(S) : KANEKO

It is certified that error appears in the above-indentified patent and that said Letters Patent is hereby corrected as shown below:

Title page, Item [56] References Cited, under "U.S. PATENT DOCUMENTS" line 2

"Miturai" should be --Mitarai--

Column 21, line 36 (claim 7, line 1), delete "single chip"

Signed and Sealed this

Thirtieth Day of December, 1997

*Attest:*

*Attesting Officer*

BRUCE LEHMAN

*Commissioner of Patents and Trademarks*

UNITED STATES PATENT AND TRADEMARK OFFICE

CERTIFICATE OF CORRECTION

PATENT NO. : 5,541,360

DATED : Jul. 30, 1996

INVENTOR(S) : Kaneko

It is certified that error appears in the above-identified patent and that said Letters Patent is hereby corrected as shown below:

Column 21, line 46 (claim 8, line 1), delete "single chip"

Signed and Sealed this

Twenty-fourth Day of March, 1998

*Attest:*

Bruce Lehman

BRUCE LEHMAN

*Attesting Officer*

*Commissioner of Patents and Trademarks*